US008651277B2

(12) United States Patent
McLeod et al.

(10) Patent No.: US 8,651,277 B2
(45) Date of Patent: Feb. 18, 2014

(54) CONTAINER WITH GUSSETED CORNER

(75) Inventors: Michael Bruce McLeod, Romeoville, IL (US); Jon Richard Thomas Schoenborn, Indianapolis, IN (US)

(73) Assignee: International Paper Company, Memphis, TN (US)

( * ) Notice: Subject to any disclaimer, the term of this patent is extended or adjusted under 35 U.S.C. 154(b) by 1540 days.

(21) Appl. No.: 12/242,339

(22) Filed: Sep. 30, 2008

(65) Prior Publication Data

US 2009/0139946 A1 Jun. 4, 2009

Related U.S. Application Data

(60) Provisional application No. 60/978,996, filed on Oct. 10, 2007.

(51) Int. Cl.
*B65D 21/00* (2006.01)
*B65D 5/28* (2006.01)
*B65D 25/00* (2006.01)

(52) U.S. Cl.
USPC ..... 206/511; 229/191; 220/62

(58) Field of Classification Search
USPC ..... 206/503, 511, 512; 220/62, 62.1, 62.12, 220/682, 666; 229/191, 915, 918, 185.1
See application file for complete search history.

(56) References Cited

U.S. PATENT DOCUMENTS

| | | | | | |
|---|---|---|---|---|---|
| 4,049,150 | A * | 9/1977 | Goettl | 220/62.1 |
| 4,613,045 | A * | 9/1986 | Watson | 206/512 |
| 4,905,834 | A * | 3/1990 | Mur Gimeno et al. | 206/512 |
| 5,507,390 | A * | 4/1996 | Vila | 206/557 |
| 5,735,405 | A * | 4/1998 | Vila | 206/511 |
| 5,860,590 | A | 1/1999 | Blomfield et al. | |
| 5,950,912 | A * | 9/1999 | Economopoulos | 229/120.32 |
| 6,371,363 | B1 | 4/2002 | Franklin et al. | |
| 6,712,214 | B1 * | 3/2004 | Wintermute et al. | 206/745 |
| 6,817,514 | B2 * | 11/2004 | Kanter et al. | 229/185.1 |
| 6,948,617 | B2 * | 9/2005 | Kanter et al. | 206/504 |
| 7,017,798 | B2 | 3/2006 | Pope et al. | |
| 7,207,473 | B2 | 4/2007 | Fry | |
| 7,819,277 | B2 * | 10/2010 | Hanson | 220/737 |
| 2007/0221670 | A1 * | 9/2007 | Cohen | 220/4.28 |
| 2008/0135607 | A1 * | 6/2008 | Barthel et al. | 229/185.1 |

* cited by examiner

*Primary Examiner* — Bryon Gehman
*Assistant Examiner* — Shawn M Braden
(74) *Attorney, Agent, or Firm* — Brian K. Jarman; Matthew M. Eslami

(57) ABSTRACT

An article-transport tray includes a floor and a side wall which cooperate to form an article-storage space sized to carry a wide variety of items, articles, or products.

44 Claims, 12 Drawing Sheets

CONTAINER WITH GUSSETED CORNER

This application claims priority under 35 U.S.C. §119(e) to U.S. Provisional Application Ser. No. 60/978,996, filed Oct. 10, 2007, which is expressly incorporated by reference herein.

BACKGROUND

The present disclosure relates to trays and containers, and particularly to stackable trays and containers made of corrugated material. More particularly, the present disclosure relates to a sturdy tray or container made of a corrugated material and configured to contain food or other items.

SUMMARY

An article-transport tray is adapted to transport food or other articles from one site to another. The article-transport tray in accordance with the present disclosure includes a floor, two side walls coupled to the floor, and two end walls coupled to the floor. The floor, side walls, and end walls cooperate to define an article-storage space therebetween.

In illustrative embodiments, the article-transport tray further includes four reinforced corners configured to increase the stacking strength and resiliency of the article-transport tray. Each reinforced corner includes a first panel, a second panel, and a corner bridge configured to interconnect the first and second panels.

In illustrative embodiments, the center bridge is appended to the first panel along a first bow-shaped fold line. The center bridge is appended to the second panel along a second bow-shaped fold line. The first and second bow-shaped fold lines lie in spaced apart relation to one another to define an hourglass shape of the center bridge.

In illustrative embodiments, the center bridge includes a trapezoid-shaped upper web, a trapezoid-shaped lower web, and a medial web configured to interconnect the upper and lower webs. The upper and lower webs are positioned to extend into the article storage space and away from the medial web.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 17 is an enlarged perspective view of the left rear portion of the blank of FIG. 16 during a first stage of folding;

FIG. 18 is a view similar to FIG. 17 during a second stage of folding;

FIG. 19 is a view similar to FIGS. 17 and 18 showing a left rear portion of a fully formed container including a gusseted container wall comprising, in series, from left to right, a first panel, a corner bridge, and a second panel and showing that the corner bridge includes a narrow medial web interconnecting variable-width upper and lower webs.

DETAILED DESCRIPTION

Figure 1:
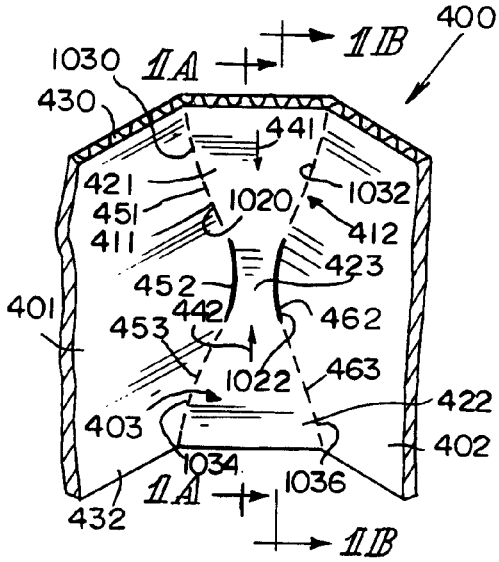
FIG. 1 is an interior perspective view of a gusseted container wall in accordance with the first embodiment of the present disclosure showing that the gusseted container wall includes, in series from left to right, a first panel, a corner bridge having an hourglass shape, and a second panel and showing that the corner bridge is arranged to interconnect the first and second panels and is appended to the first panel along a first bow-shaped fold line comprising a first perforated segment at the top, a second perforated segment at the bottom, and a first curved slit located between the first and second perforated segments, and showing that the corner bridge is appended to the second panel along a second bow-shaped fold line comprising a first perforated segment, a second perforated segment, and a second curved slit located between the first and second perforated segments of the second bow-shaped fold line.
Figure 2:
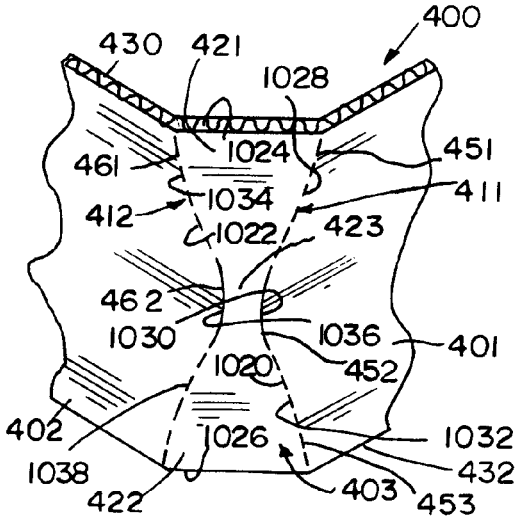
FIG. 2 is an exterior perspective view of the gusseted container wall of FIG. 1 showing that the narrow medial web of the corner bridge interconnects the variable-width upper and lower webs of the corner bridge.
Figure 1A:
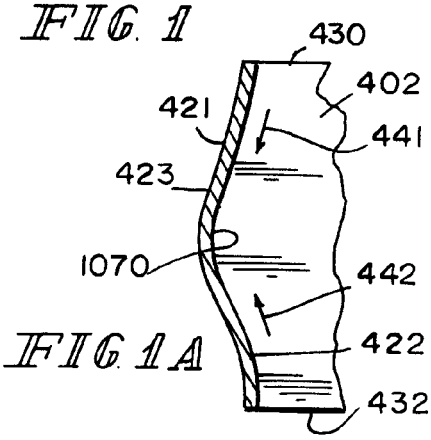
FIG. 1A is a sectional view taken along line 1A-1A of FIG. 1 showing that the corner bridge includes a positively sloping upper web, a negatively sloping lower web, and a medial web interconnecting the upper and lower webs.
Figure 1B:
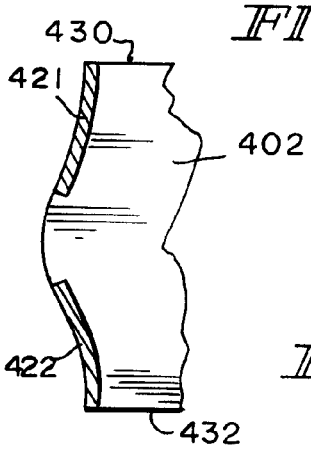
FIG. 1B is a sectional view taken along line 1B-1B of FIG. 1 showing an opening formed in the second bow-shaped fold line by the second curved slit and showing a portion of the upper web above the second curved slit and a portion of the lower web below the second curved slit.
Figure 3:
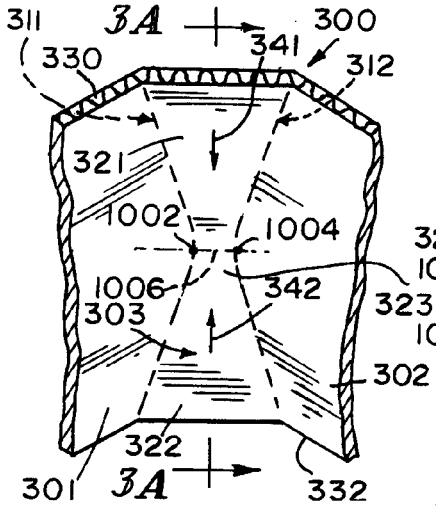
FIG. 3 is an interior perspective view of a gusseted container wall in accordance with a second embodiment of the present disclosure showing that the gusseted container wall includes in series, from left to right, a first panel, a corner bridge having an hourglass shape, and a second panel and showing that the corner bridge is arranged to interconnect the first and second panels and showing that the corner bridge is appended to the first panel along a first bow-shaped fold line and to the second panel along a second bow-shaped fold line.
Figure 4:
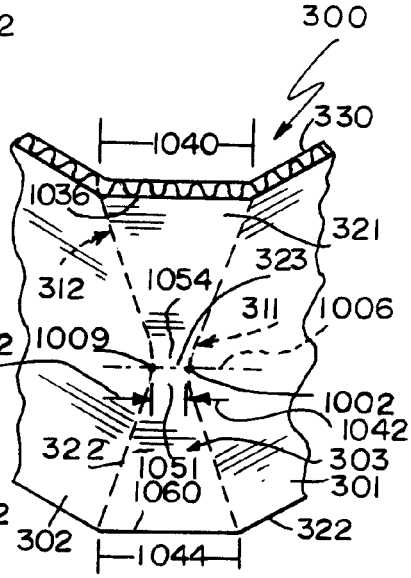
FIG. 4 is an exterior perspective view of the gusseted container wall of FIG. 3 showing that the narrow medial web of the corner bridge interconnects the variable-width upper and lower webs of the corner bridge.
Figure 10:
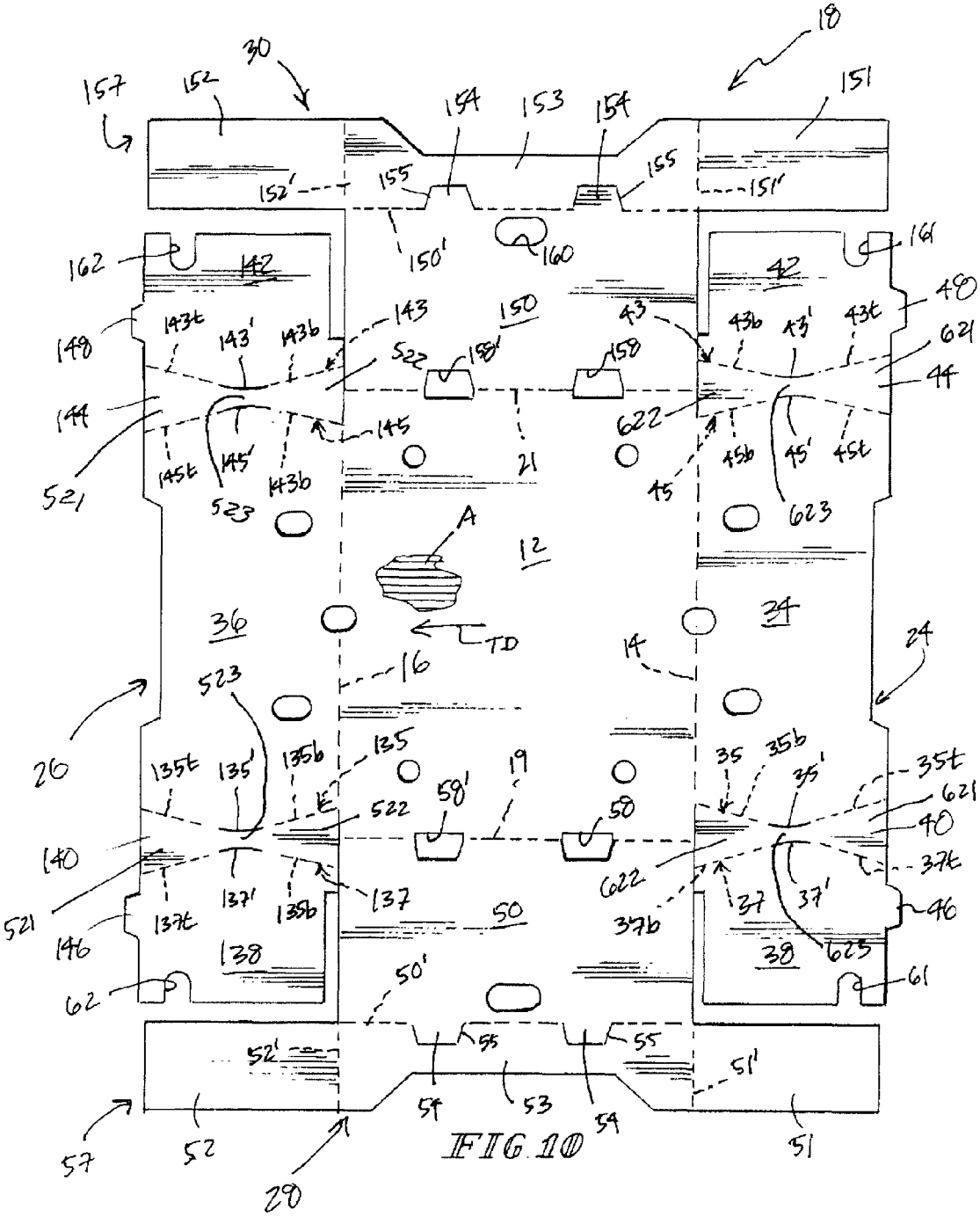
FIG. 10 is a plan view of a blank of material used to form the container of FIGS. 5 and 6 showing a floor, a left side strip appended to a left side edge of the floor and formed to include hourglass-shaped first and second corner bridges, a right side strip appended to a right side edge of the floor and formed to include hourglass-shaped third and fourth corner bridges, a multi-panel front end closure coupled to a front end edge of the floor that is arranged to extend between the second and third corner bridges, and a multi-panel rear end closure coupled to a rear end edge of the floor that is arranged to extend between the first and fourth corner bridges.
Figure 20:
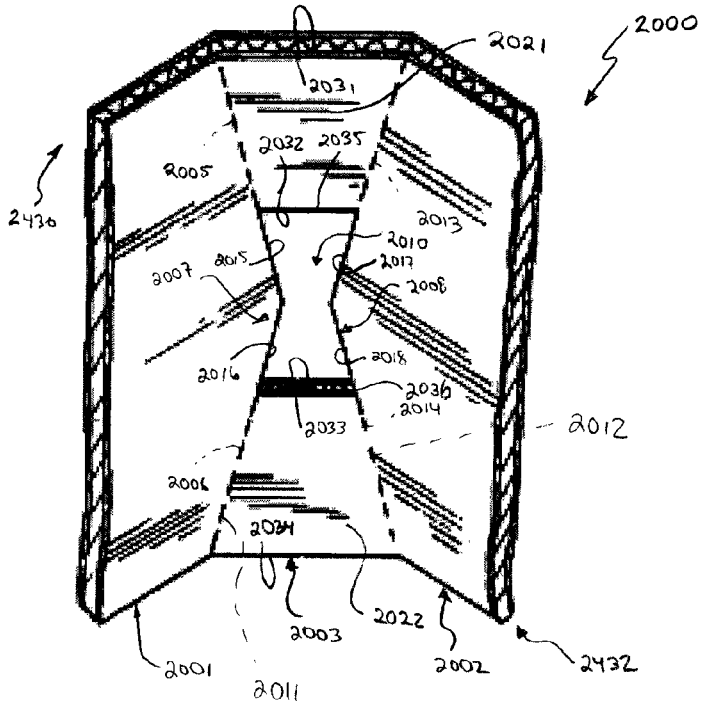
FIG. 20 is an interior perspective view of a gusseted container wall in accordance with a third embodiment of the present disclosure showing that the gusseted container wall includes in series, from left to right, a first panel, a corner bridge having an hourglass shape, and a second panel and showing that the corner bridge includes in series, from top to bottom, an upper web, an hourglass shaped window aperture opening through the corner bridge, and a lower web.
Figure 21:
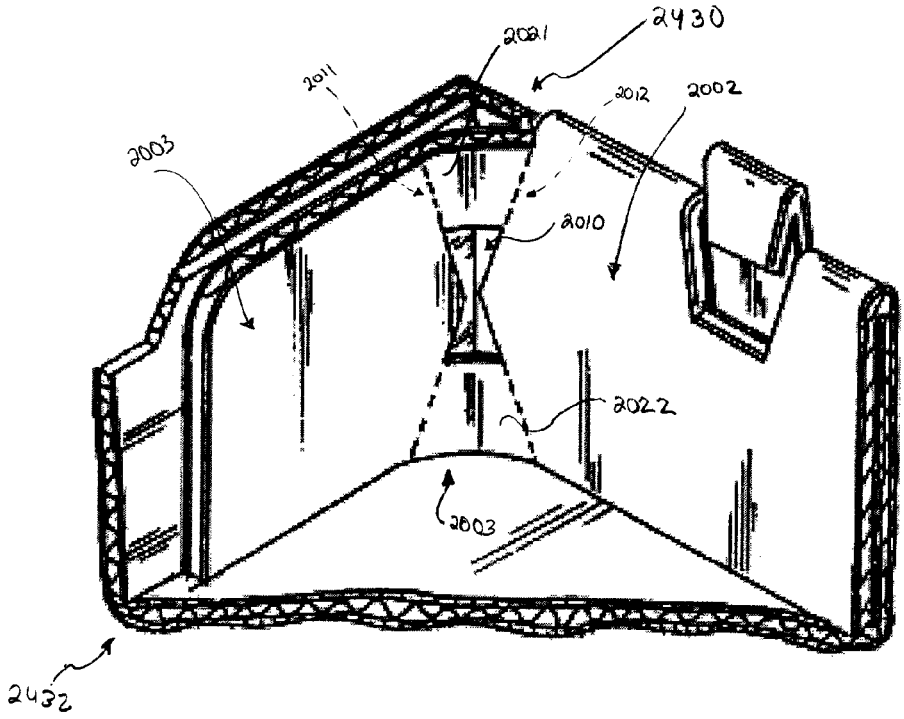
FIG. 21 is a view similar to FIG. 19 showing a left rear portion of a fully formed container including a gusseted container wall comprising, in series from left to right, a first panel, a corner bridge formed to include an hourglass shaped window aperture opening through the corner bridge to reveal the exterior corner of the container behind the gusseted container wall, and a second panel.
Figure 22:
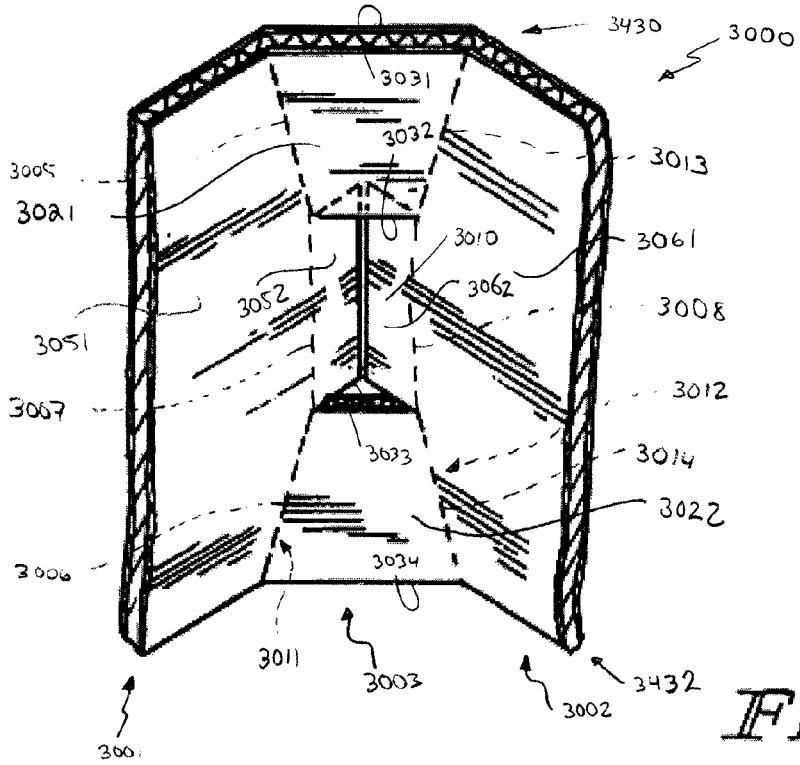
FIG. 22 is an interior perspective view of a gusseted container wall in accordance with a fourth embodiment of the present disclosure showing that the corner bridge includes an upper web defined on the left by a first a bow-shaped fold line and on the right by a second bow-shaped fold line, a lower web defined on the left by the first bow-shaped fold line and on the right by a second bow-shaped fold line, and a rectangular window aperture formed in the corner bridge between the upper web and the lower web, and showing that the rectangular window aperture is defined on the left by a first straight pivot line included in the first bow-shaped fold line, on the right by a second straight pivot line included in the second bow-shaped fold line, at the top by a bottom side of the upper web, and at the bottom by a top side of the lower web.
Figure 23:
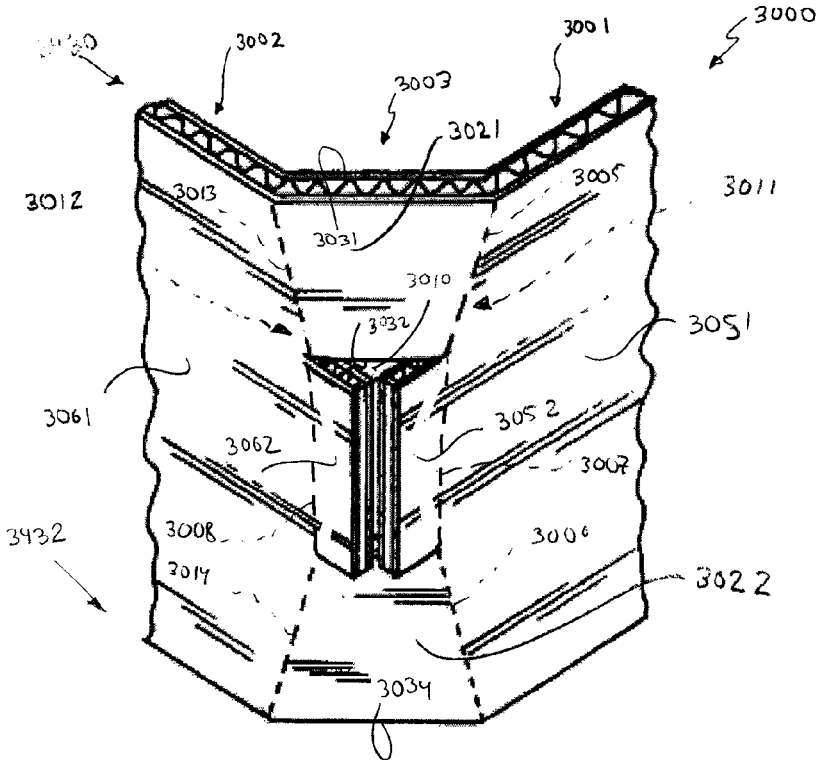
FIG. 23 is an exterior perspective view of the gusseted container wall of FIG. 22 showing that the first panel includes a first panel section and a first panel wing appended to the first panel section along the first straight pivot line and showing that the second panel includes a second panel section and a second panel wing appended to the second panel section along the second straight pivot line.
Figure 24:
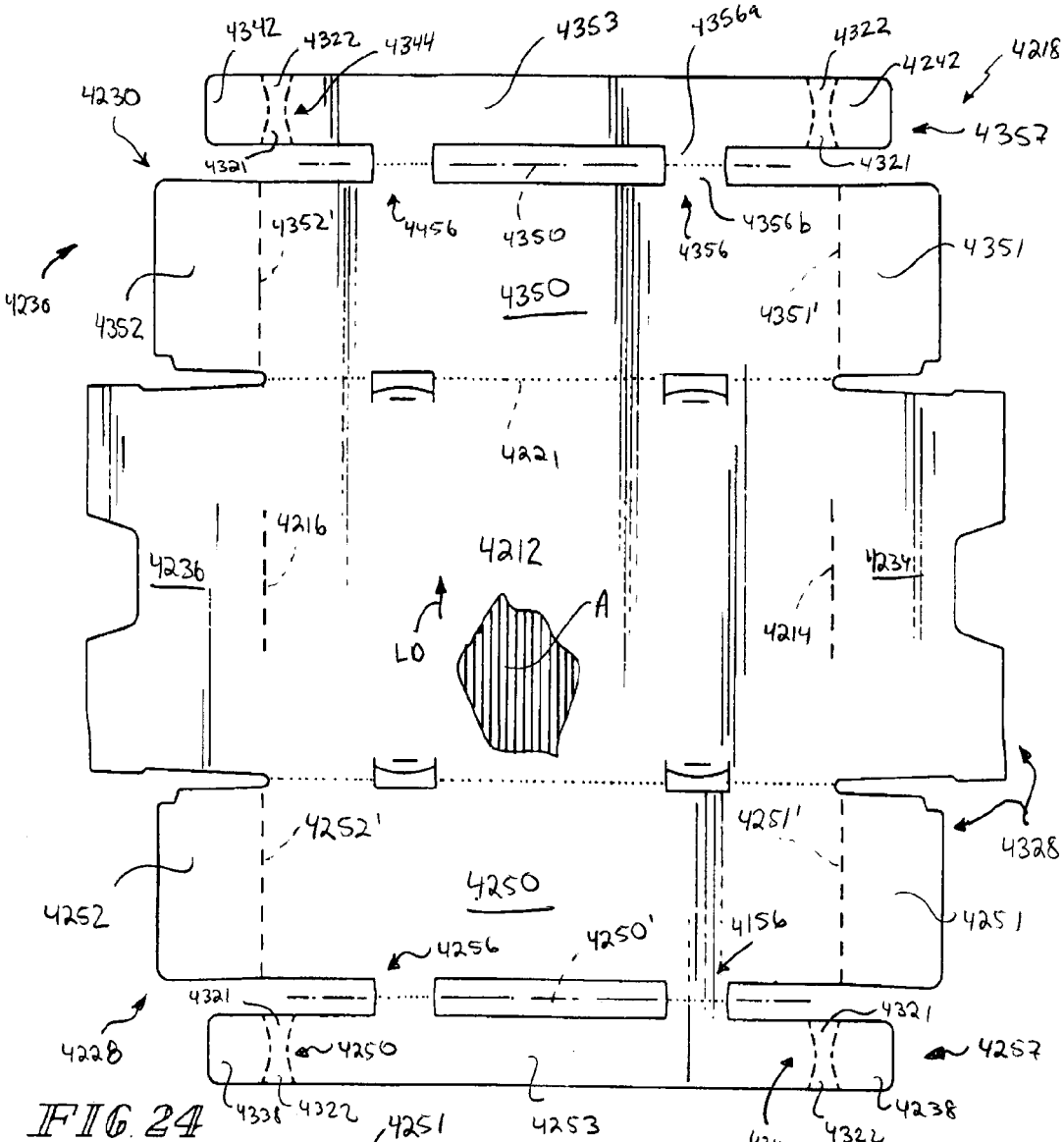
FIG. 24 is a plan view of a blank of material formed to include four corner bridges in accordance with a fifth embodiment of the present disclosure showing that perforations are formed in the blank to define a bow-shaped fold line along each edge of the hourglass-shaped corner bridges included in a gusseted container wall.
Figure 25:
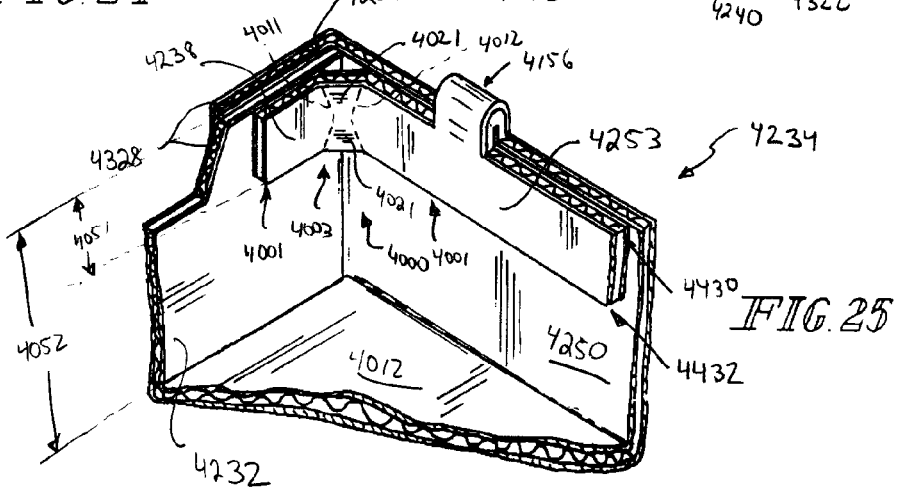
FIG. 25 is an interior perspective view of the gusseted container formed by assembling the blank of FIG. 24 and showing the gusseted container wall extends downwardly from the top edge of the article-transport tray toward the floor and is configured to have a height less than the exterior container wall's height.
Figure 26:
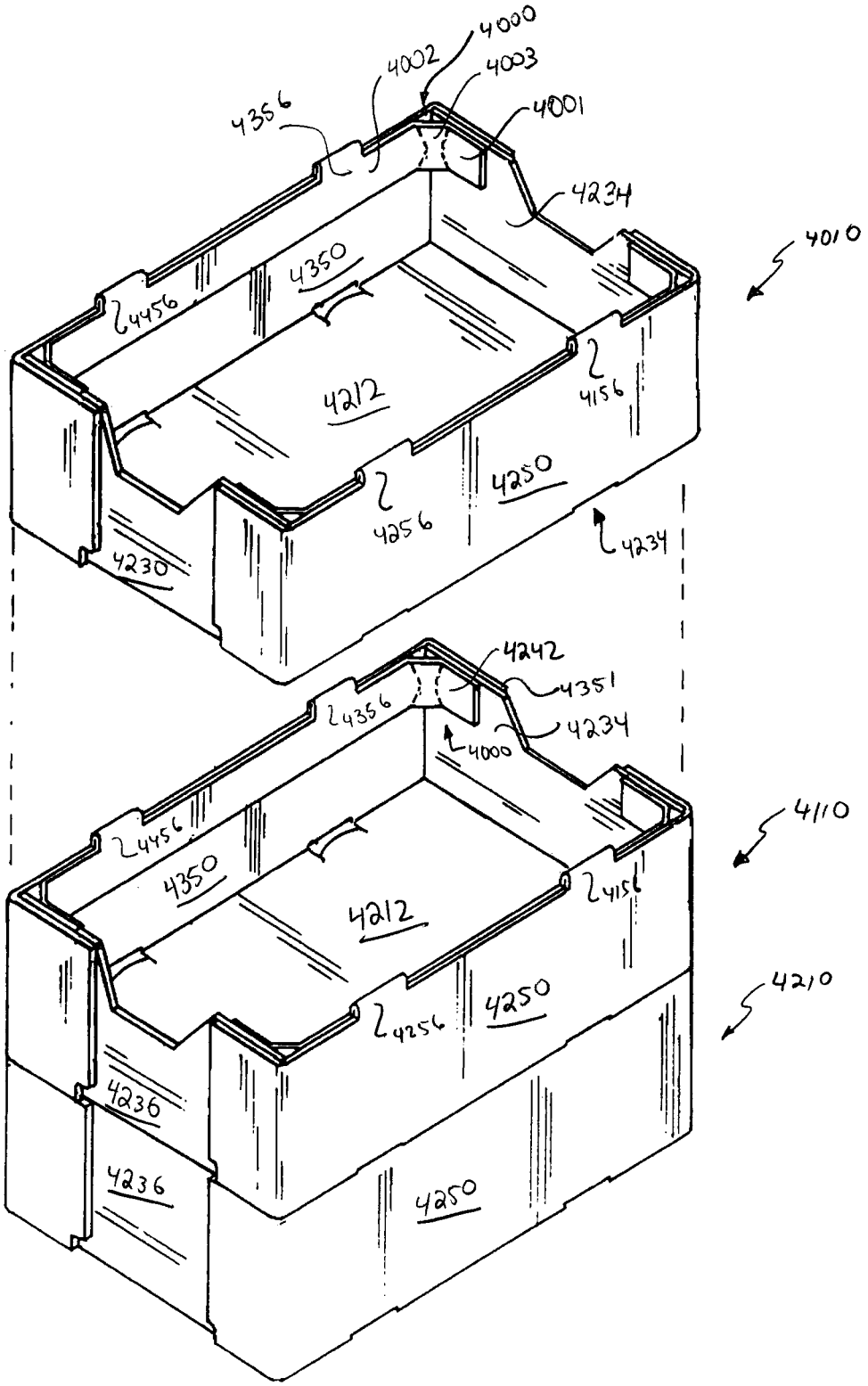
FIG. 26 is a perspective view of an article-transport tray formed from the blank illustrated in FIG. 24 and showing three article-transport trays being stacked together to form an article-tray stack and showing that the gusseted container wall of the lower article-transport tray cooperates with the floor of the upper article-transport tray to reduce the possibility of the upper article-transport tray nesting within the lower article-transport tray.

A gusseted container wall 400 in accordance with a first embodiment of the present disclosure is shown in FIGS. 1-2, and is well suited for use in a container such as article-transport tray 10 illustrated in FIGS. 5-15. A gusseted container wall 300 in accordance with a second embodiment of the present disclosure is shown in FIGS. 3-4, and is well suited for use in a container such as article-transport tray 210 illustrated in FIGS. 16-19. A gusseted container wall 2000 in accordance with a third embodiment of the present disclosure is shown in FIGS. 20 and 21 and is adapted for use in a container similar to article-transport tray 10, 210. A gusseted container wall 3000 in accordance with a fourth embodiment of the present disclosure is shown in FIGS. 22 and 23 and is suited for use in a container similar to article-transport tray 10, 210. A gusseted container wall 4000 in accordance with a fifth embodiment of the present disclosure is shown in FIGS. 24-26, and is well suited for use in a container such as article-transport tray 4010 illustrated in FIG. 26. In each of the first four embodiments, gusseted container wall establishes a portion of a reinforced corner of a container. In the fifth embodiment, gusseted container wall establishes a portion of an anti-nesting corner of a container. Exemplary blanks 18, 218, 4218 (of corrugated material) can be folded to produce a tray or container including a gusseted container wall in accordance with the present disclosure as shown in FIGS. 10, 16, and 24.

Gusseted container wall 400 includes a first panel 401, a second panel 402, and a corner bridge 403 interconnecting first and second panels 401, 402 as shown in FIGS. 1 and 2. Corner bridge 403 is appended to first panel 401 along a first bow-shaped fold line 411 and to second panel 402 along a second bow-shaped fold line 412. In an illustrative embodiment, corner bridge 403 has a shape resembling an hourglass and comprises an upper web 421, a lower web 422, and a medial web 423 interconnecting upper and lower webs 421, 422.

Upper web 421 of corner bridge 403 extends downwardly from a top edge 430 of gusseted container wall 400 to mate with a relatively narrow medial web 423 as suggested in FIGS. 1 and 2. The width of upper web 421 varies along the length of upper web 421 as suggested in FIGS. 1 and 2. Side edges of upper web 421 extend along first and second bow-shaped fold lines 411, 412 and converge in a first direction 441 away from top edge 430 and toward narrow medial web 423 in an illustrative embodiment shown in FIGS. 1 and 2.

Lower web 422 of corner bridge 403 extends upwardly from a bottom edge 432 of gusseted container wall 400 to mate with a relatively narrow medial web 423 as suggested in FIGS. 1 and 2. The width of lower web 422 varies along the length of lower web 422 as suggested in FIGS. 1 and 2. Side edges of lower web 422 extend along bow-shaped fold lines 411, 412 and converge in a second inward direction 442 away from bottom edge 432 and toward medial web 423.

First bow-shaped fold line 411 includes, in series, extending from top edge 430 to bottom edge 432, a first perforated segment 451, a first curved slit 452, and a second perforated segment 453. It is within the scope of the present disclosure to omit either first curved slit 452 or first and second perforated segments 451, 453 from first bow-shaped fold line 411.

Second bow-shaped fold line 412 includes, in series, extending from top edge 430 to bottom edge 432, a first perforated segment 461, a second curved slit 462, and a second perforated segment 463. It is within the scope of the present disclosure to omit either second curved slit 462 or first and second perforated segments 461, 463 from second bow-shaped fold line 412.

In illustrative embodiments, as suggested in FIGS. 1 and 2, first perforated segments 451, 461 are arranged to bow outwardly in opposite directions and second perforated segments 453, 463 are arranged to bow outwardly in opposite directions. In contrast, first and second curved slits 452, 462 are arranged to bow inwardly toward one another to define the narrow medial web 423 therebetween as shown, for example, in FIGS. 1 and 2.

Gusseted container wall 300 includes a first panel 301, a second panel 302, and a corner bridge 303 interconnecting first and second panels 301, 302 as shown in FIGS. 3 and 4. Corner bridge 303 is appended to first panel 301 along a first bow-shaped fold line 311 and to second panel 302 along a second bow-shaped fold line 312. In an illustrative embodiment, corner bridge 303 has a shape resembling an hourglass and comprises an upper web 321, a lower web 322, and a medial web 323 interconnecting upper and lower webs 321, 322.

Upper web 321 of corner bridge 303 extends downwardly from a top edge 330 of gusseted container wall 300 to mate with a relatively narrow medial web 323 as suggested in FIGS. 1 and 2. The width of upper web 321 varies along the length of upper web 321 as suggested in FIGS. 3 and 4. Side edges of upper web 321 extend along first and second bow-shaped fold lines 311, 312 and converge in a first rearward direction 341 away from top edge 330 and toward narrow medial web 323 in an illustrative embodiment shown in FIGS. 3 and 4.

Lower web 322 of corner bridge 303 extends upwardly from a bottom edge 332 of gusseted container wall 300 to mate with a relatively narrow medial web 323 as suggested in FIGS. 3 and 4. The width of lower web 322 varies along the length of lower web 322 as suggested in FIGS. 3 and 4. Side edges of lower web 322 extend along bow-shaped fold lines 311, 312 and converge in a second inward direction 342 away from bottom edge 332 and toward medial web 323.

Figure 5:
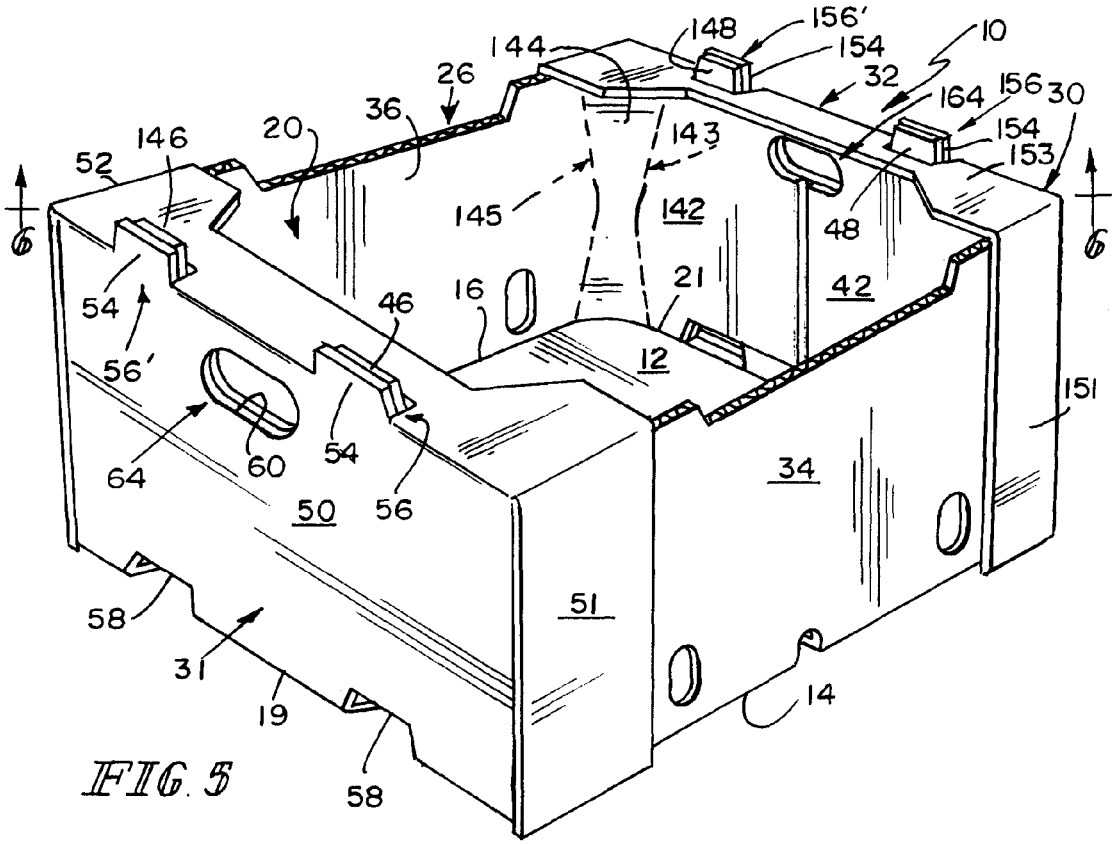
FIG. 5 is a perspective view of an erected article-transport tray including four reinforced corners, each corner including a corner bridge of the type illustrated in FIGS. 1 and 2 and showing a first of the four corner bridges in the rear of the article-transport tray.

An article-transport tray 10 is provided, as shown in FIG. 5, for carrying various items. Article-transport tray 10 is formed to include an article-storage space 20 for receiving various items such as fruits, vegetables, or any type of agricultural or meat product (not shown). Article-transport tray 10 is well-suited to carry a wide variety of other items, articles, or products.

Article-transport tray 10 is made, for example, from a blank 18 of corrugated material, as shown in FIG. 10. Blank 18 includes floor 12, a right side strip 24 appended to floor 12 along fold line 14, a left side strip 26 appended to floor 12 along fold line 16, a front end closure 28 appended to floor 12 along fold line 19, and a rear end closure 30 appended to floor 12 along fold line 21. Rear end closure 30 is configured to be folded as suggested in FIG. 11 to produce a rear end 32 of tray 10 as suggested in FIGS. 5 and 12. Front end closure 28 is configured to be folded as suggested in FIG. 12 to produce a front end 31 of tray 10 as suggested in FIG. 5. It is within the scope of the present disclosure to make blank 18 from a variety of materials including corrugated paperboard, folding carton, and solid fiber and other materials such as plastic sheeting and plastic corrugated.

Right side strip 24 includes a right side wall 34, a first front end wall anchor flap 38, a front right corner bridge 40, a first rear end wall anchor flap 42, and a rear right corner bridge 44 as shown in FIG. 10. Right side wall 34 is appended to floor 12 along fold line 14 and is sized to extend nearly along the entire length of floor 12. Right side strip 24 also includes a front right stacking tab 46 appended to an outer corner of first front end wall anchor flap 38 and a rear right stacking tab 48 appended to an outer corner of first rear end wall anchor flap 42 as shown in FIG. 10.

Each of corner bridges 40, 44 has a shape resembling an hourglass in an illustrative embodiment. Each corner bridge includes an upper web 621, a lower web 622, and a medial web 623 interconnecting upper and lower webs 621, 622 as shown, for example, in FIGS. 10 and 13-15.

Front right corner bridge 40 is arranged to interconnect right side wall 34 (first panel) and first front end wall anchor flap 38 (second panel) as shown in FIG. 10. Front right corner bridge 40 is appended to right side wall 34 along first bow-shaped fold line 35 and to first front end wall anchor flap 38 along second bow-shaped fold line 37 as shown in FIG. 10. Right side strip 24 is formed to include an upwardly bowed smile-shaped curved slit 35' along fold line 35 and a downwardly bowed frown-shaped curved slit 37' along second bow-shaped fold line 37 as suggested in FIG. 10. First bow-shaped fold line 35 also includes first perforated segment **35*t* and second perforated segment 35*b*. These segments 35*t* and 35*b* can be straight or curved. Second bow-shaped fold line 37 also includes first perforated segment 37*t* and second perforated segment 37*b*. These segments 37*t* and 37*b*** can be straight or curved.

Rear right corner bridge 44 is arranged to interconnect right side wall 34 (second panel) and first rear end wall anchor flap 42 (first panel) as shown in FIG. 10. Rear right corner bridge 44 is appended to right side wall 34 along first bow-shaped fold line 45 and to first rear end wall anchor flap 42 along second bow-shaped fold line 43. Right side strip 24 is also formed to include an upwardly bowed smile-shaped curved slit 143' along fold line 143 and a downwardly bowed frown-shaped curved slit 145' along fold line 145 as suggested in FIG. 10. Each of front and rear right corner bridges 40, 44 is hourglass shaped in the embodiment shown in FIG. 10. First bow-shaped fold line 45 also includes first perforated segment **45*t* and second perforated segment 45*b*. These segments 45*t* and 45*b* can be straight or curved. Second bow-shaped fold line 43 also includes first perforated segment 43*t* and second perforated segment 43*b*. These segments 43*t* and 43*b*** can be straight or curved.

Figure 14:
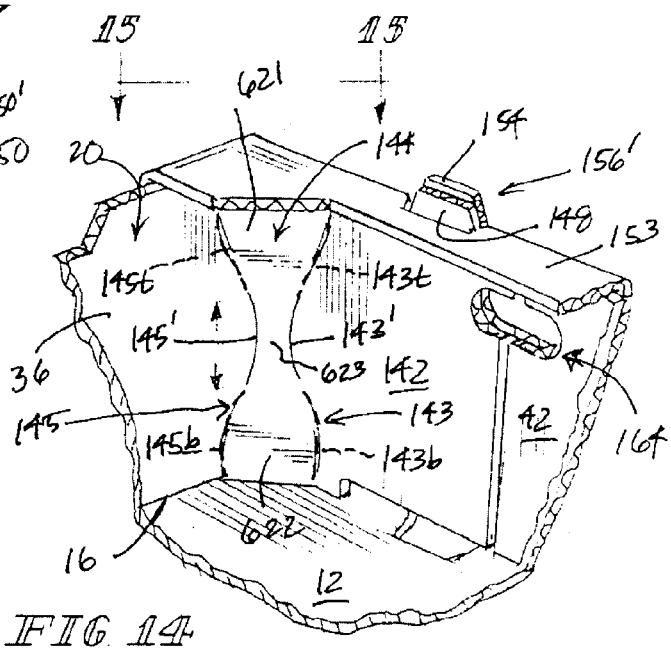
FIG. 14 is an enlarged perspective view of a left rear portion of the container of FIG. 5 showing the interior surface of the first corner bridge.
Figure 15:
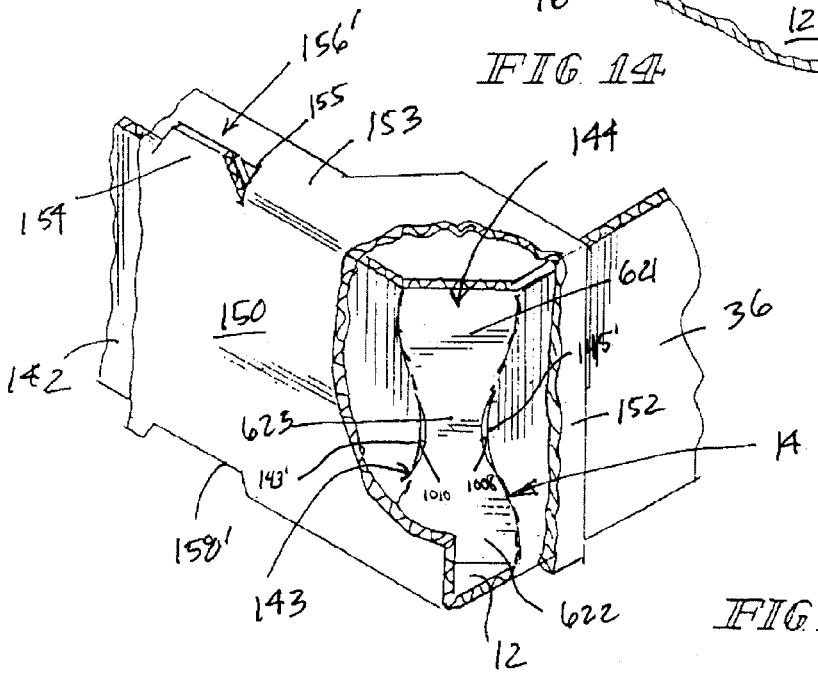
FIG. 15 is a perspective view of the left rear portion of the container of FIG. 5 taken from another point of view showing the exterior surface of the first corner bridge.
Figure 16:
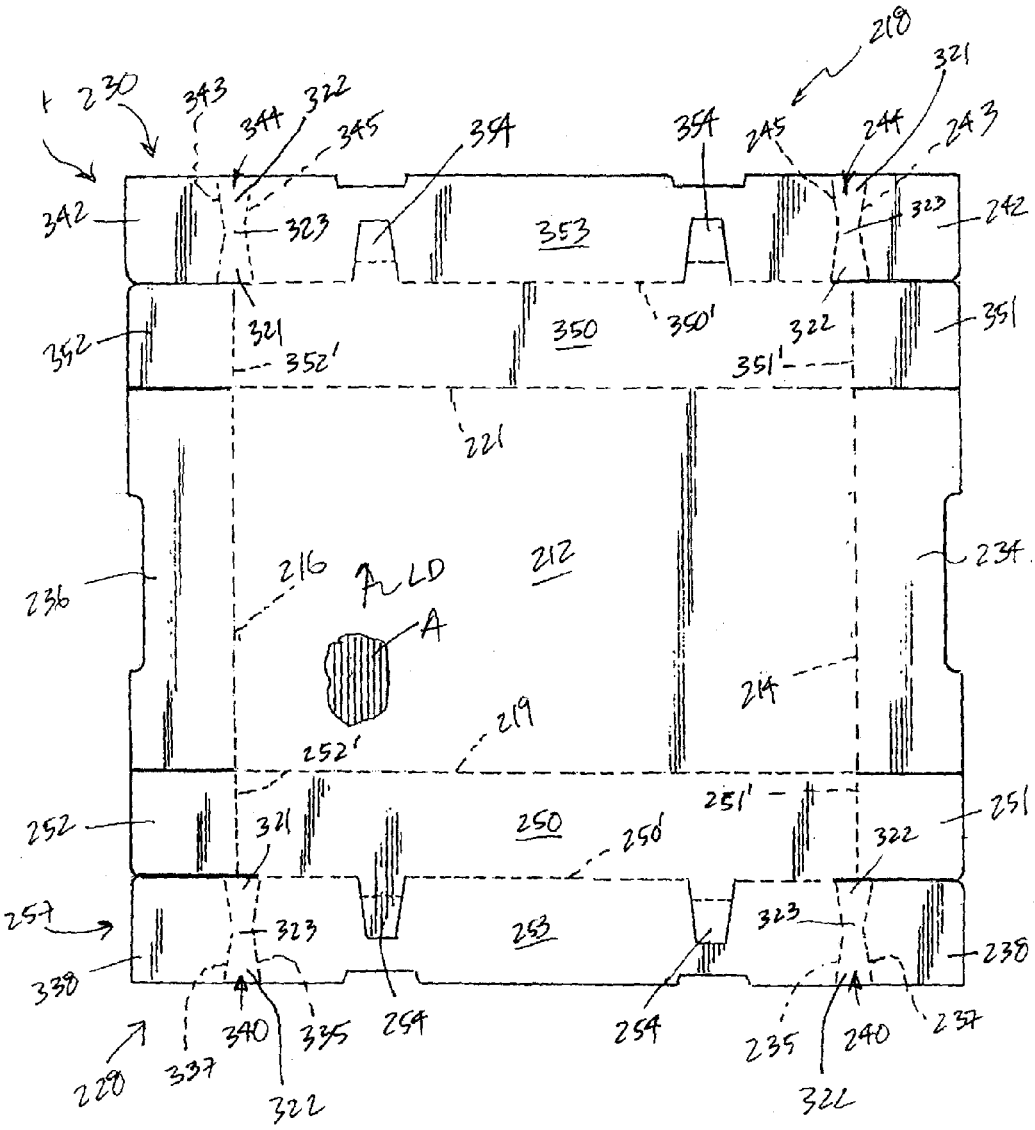
FIG. 16 is a plan view of a blank of material formed to include four corner bridges in accordance with another embodiment of the disclosure showing that perforations are formed in the blank to define a bow-shaped fold line along each edge of the hourglass-shaped corner bridges.

As illustrated in FIGS. 14 and 15, first curved slit 145' is shaped to define a first concave edge 1008. First concave edge 1008 is arranged to face in a first direction toward first panel 36. Second curved slit 143' is shaped to define a second concave edge 1010. Second concave edge 1010 is arranged to face a second direction toward second panel 142. First and second concave edges 1008, 1010 cooperate to define medial web 623 therebetween.

Illustratively first top perforated segment 451 is arranged to curve outwardly away from center bridge 403 to produce a first top convex edge 1030 facing first panel 401. Second top perforated segment 412 is arranged to curve outwardly away from center bridge 403 to produce a second top convex edge 1032 facing second panel 402. First and second top convex edges 1030, 1032 cooperated to define upper web 421 therebetween as shown in FIG. 1.

First bottom perforated segment 453 is arranged to curve outwardly away from center bridge 403 to produce a first bottom convex edge 1034 facing first panel 401. Second bottom perforated segment 463 is arranged to curve outwardly away from center bridge 403 to produce a second bottom convex edge 1036 facing second panel 402. First and second bottom convex edges 1034, 1036 cooperate to define lower web 422 therebetween as suggested in FIG. 1.

Left side strip 26 includes a left side wall 36, a second front end wall anchor flap 138, a front left corner bridge 140, a second rear end wall anchor flap 142, and a rear left corner bridge 144 as shown in FIG. 10. Left side wall 36 is appended to floor 12 along fold line 16 and is sized to extend nearly along the entire length of floor 12. Left side strip 26 also includes a front left stacking tab 146 appended to an outer corner of second front end wall anchor flap 138 and a rear left stacking tab 148 appended to an outer corner of second rear end wall anchor flap 142 as shown in FIG. 10.

Each of corner bridges 140, 144 has a shape resembling an hourglass in an illustrative embodiment. Each of corner bridges 140, 144 comprises an upper web 521, a lower web 522, and a medial web 523 interconnecting upper and lower webs 521, 522 as shown, for example, in FIGS. 10 and 13-15.

Front left corner bridge 140 is arranged to interconnect left side wall 36 (second panel) and first rear end wall anchor flap 138 (first panel). Front left corner bridge 140 is appended to left side wall 36 along first bow-shaped fold line 135 and to first rear end wall anchor flap 138 along second bow-shaped fold line 137 as shown in FIG. 10. Left side strip 26 is formed to include an upwardly bowed smile-shaped curved slit 135' along fold line 135 and a downwardly bowed frown-shaped curved slit 137' along fold line 137 as suggested in FIG. 10. First bow-shaped fold line 135 also includes first perforated segment 135*t* and second perforated segment 135*b*. These segments 135*t* and 135*b* can be straight or curved. Second bow-shaped fold line 137 also includes first perforated segment 137*t* and second perforated segment 137*b*. These segments 137*t* and 137*b* can be straight or curved.

Rear left corner bridge 144 is arranged to interconnect left side wall 36 (first panel) and second rear end wall anchor flap 142 (second panel). Rear left corner bridge 144 is appended to left side wall 36 along first bow-shaped fold line 145 and to second rear end wall anchor flap 142 along second bow-shaped fold line 143. Left side strip 26 is formed to include an upwardly bowed smile-shaped curved slit 143' along fold line 143 and a downwardly bowed frown-shaped curved slit 145' along fold line 145 as shown in FIG. 10. Each of front and rear left corner bridges 140, 144 is hourglass shaped in the embodiment shown in FIG. 10. First bow-shaped fold line 145 also includes first perforated segment 145*t* and second perforated segment 145*b*. These segments 145*t* and 145*b* can be straight or curved. Second bow-shaped fold line 143 also includes first perforated segment 143*t* and second perforated segment 143*b*. These segments 143*t* and 143*b* can be straight or curved.

First perforated segments 35*t*, 37*t* of first and second bow-shaped fold lines 35, 37 are arranged to lie in diverging relation to one another. Illustratively, first perforated segments 35*t*, 37*t* diverge outwardly from medial web 625. Second perforated segments 35*b*, 37*b* of first and second bow-shaped fold lines 35, 37 are also arranged to lie in diverging relation to one another. Illustratively, second perforated segments 35*b*, 37*b* diverge outwardly from medial web 625. Each of the corner bridges 40, 44, 140, 144 included in blank 18 have substantially the same positional relationship of the first perforated segments of the first and second bow-shaped fold lines.

First and second perforated segments 35*t*, 35*b*, 37*t*, 37*b* of first and second bow-shaped fold lines 35, 37 are arranged to lie in diverging relation to one another. As shown in FIG. 10, first and second perforated segments 35*t*, 35*b* cooperate to define a first obtuse angle therebetween. First and second perforated segments 37*t*, 37*b* cooperate to define a second obtuse angle between. First perforated segments 35*t*, 37*t* cooperate to define a first acute angle therebetween. Second perforated segments 35*b*, 37*b* cooperate to define a second acute angle therebetween.

Illustratively, first perforated segments 35*t*, 37*t* cooperate to define a generally trapezoidal shaped upper web 621. Second perforated segments 35*b*, 37*b* cooperated to define a generally trapezoidal shaped lower web 622. First and second perforated segments 35*b*, 35*t* of bow-shaped fold line 35 intersect at a first point 1002. First and second perforated segments 37*b*, 37*t* of second bow-shaped fold line 37 intersect at a second point 1004. First and second point 1002, 1004 illustratively lie on a line 1006. First and second points 1002, 1004 and line 1006 are illustratively shown in FIG. 3.

Line 1006 is illustratively positioned to lie equidistant between top end 330 and bottom end 332 of gusseted container wall 300. Line 1006 illustratively is parallel to floor 12, but may be positioned to lie at an angle with respect to floor 12.

As shown in FIG. 2, first bow-shaped fold line 411 defines a first bridge side 1020 of corner bridge 403. First bridge side 1020 is arranged to face first panel 401 and includes a first top side portion 1028, a first center side portion 1030, and a first bottom side portion 1032. First top side portion 1028 is positioned to lie above floor 12. First center side portion 1030 is positioned to lie below the first top side portion 1028 and above floor 12. First bottom side portion 1032 is positioned to lie below first center side portion 1030 and above floor 12. Second bow-shaped fold line 412 defines a second bridge side 1022 of corner bridge 403. Second bridge side 1022 is arranged to face second panel 402 and includes a second top side portion 1034, a second center side portion 1036, and a second bottom side portion 1038. Second top side portion 1034 is positioned to lie above floor 12. Second center side portion 1036 is positioned to lie below the second top side portion 1034 and above floor 12. Second bottom side portion 1038 is positioned to lie below second center side portion 1036 and above floor 12.

As illustrated in FIG. 4, first and second top side portions 1028, 1034 are spaced apart from each other do define a top distance 1040 therebetween. First and second center side portions 1030, 1036 are spaced apart from each other to define a center distance 1042 therebetween. First and second bottom side portions 1032, 1038 are spaced apart from each other to define a bottom distance 1044 therebetween. Illustratively, top distance 1040 and bottom distance 1044 are greater than center distance 1042. Top distance 1040 is about the same as bottom distance 1044.

Corner bridge 403 is further configured to include a top bridge side 1024 and a bottom bridge side 1026 as shown in FIGS. 1 and 2. Top bridge side 1024 is positioned to lie coplanar with top edge 430 of gusseted container wall 400.

Bottom bridge side 1026 is positioned to lie coplanar with bottom edge 432 of gusseted container wall.

Figure 11:
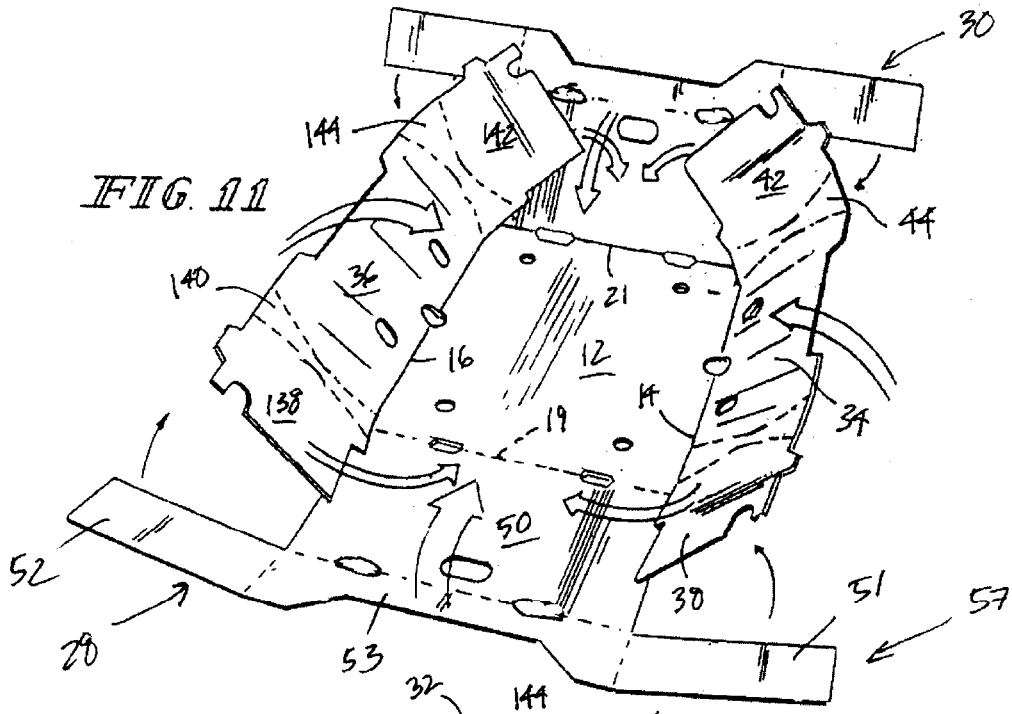
FIG. 11 is a perspective view of the blank of FIG. 10 being folded to pivot the rear end closure and the left and right side strips upwardly relative to the floor.

Front end closure 28 includes a front end wall 50 coupled to one end of floor 12 along fold line 19 and a front anchor strip 57 coupled to front end wall 50 along fold line 50' as suggested in FIGS. 10 and 11. Front anchor strip 57 includes a front tray-support platform 53 coupled to front end wall 50 along fold line 50', a first platform anchor flap 51 coupled to one end of front tray-support platform 53 along fold line 51', and a second platform anchor flap 52 coupled to an opposite end of front tray-support platform 53 along fold line 52' as suggested in FIG. 10.

Rear end closure 30 includes a rear end wall 150 coupled to an opposite end of floor 12 along fold line 21 and a rear anchor strip 157 coupled to rear end wall 150 along fold line 150' as suggested in FIGS. 10 and 11. Rear anchor strip 157 includes a rear tray-support platform 153 coupled to end wall 150 along fold line 150', a first platform anchor flap 151 coupled to one end of rear tray-support platform 153 along fold line 151', and a second platform anchor flap 152 coupled to an opposite end of rear tray-support platform 153 along fold line 152' as suggested in FIG. 10.

In an illustrative embodiment, the corrugation of blank 18 is positioned to run in a transverse direction TD as shown in insert A in FIG. 10. It is within the scope of the present disclosure to establish each of the fold lines disclosed herein by using score lines, creases, perforations, or perforations and score lines or by using another suitable technique.

As shown in FIG. 10, front end closure 28 also includes two spaced-apart trapezoid-shaped front stacking tabs 54 appended to front end wall 50. Front end closure 28 is formed to include a pair of slits 55 and one of slits 55 separates front tray-support platform 53 from each front stacking tab 54 when blank 18 is in an unfolded state as shown in FIG. 3. Stacking tabs 54 are arranged to lie alongside front right and left stacking tabs 46, 146 when tray 10 is erected as suggested in FIG. 1. Tab 46 and one of tabs 54 cooperate to form a first alignment tab 56 that is sized to fit into a portion of tab receiver 58 formed in an overlying companion tray (not shown). Tab receiver 58 is formed in blank 18 along fold line 19 as shown in FIG. 10 (see also FIG. 5). Tab 146 and the other of tabs 54 cooperate to form a second alignment 56' that is sized to fit into a portion of a tab receiver 58' formed in an overlying companion tray (not shown). Tab receiver 58' is formed in blank 18 along fold line 19 as shown in FIG. 10.

As shown in FIG. 10, front end wall 50 is formed to include a finger-receiving slot 60. Also, first front end wall anchor flap 38 is formed to include a first cutout 61 and second front end wall anchor flap 138 is formed to include a second cutout 62 as shown in FIG. 10. When tray 10 is erected as suggested in FIGS. 11 and 12, slot 60 and cutouts 61, 62 cooperate to form a hand-hold opening 64 in front end closure 28.

As also shown in FIG. 10, rear end wall 150 is formed to include a finger-receiving slot 160. Also, first rear end wall anchor flap 42 is formed to include a first cutout 161 and second rear end wall anchor flap 142 is formed to include a second cutout 162 as shown in FIG. 3. When tray 10 is erected as suggested in FIGS. 11 and 12, slot 160 and cutouts 161, 162 cooperate to form a hand-hold opening 164 in rear end closure 30.

As also shown in FIG. 10, rear end closure 30 also includes two trapezoid-shaped rear stacking tabs 154 appended to rear end wall 150. Rear end closure 30 is formed to include a pair of slits 155 and one of slits 55 separates rear tray-support platform 153 from each rear stacking tab 154 when blank 18 is in an unfolded state as shown in FIG. 10. Stacking tabs 154 are arranged to lie alongside rear right and left stacking tabs 48, 148 when tray 10 is erected as suggested in FIG. 5. Tab 48 and one of tabs 154 cooperate to form a first alignment tab 156 that is sized to fit into a portion of a tab receiver 158 formed in an overlying companion tray (not shown). Tab receiver 158 is formed in blank 18 along fold line 21 as shown in FIG. 10. Tab 148 and the other of tabs 154 cooperate to form a second alignment 156' that is sized to fit into a portion of a tab receiver 158' formed in an overlying companion tray (not shown). Tab receiver 158' is formed in blank 18 along fold line 21 as shown in FIG. 10.

Figure 6:
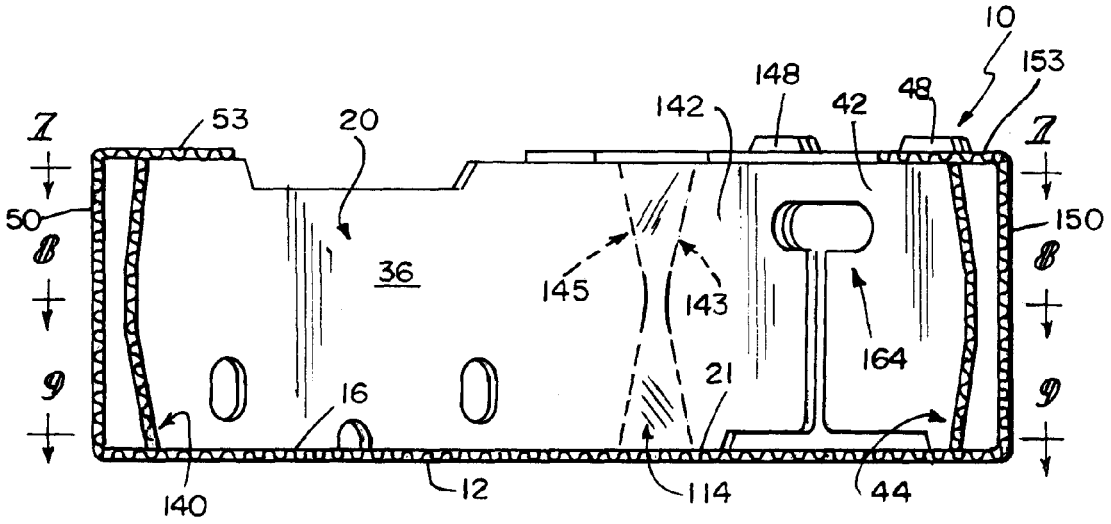
FIG. 6 is a sectional view taken along line 6-6 of FIG. 5 showing the first corner bridge (in full) and portions (in section) of the second and fourth corner bridges.
Figure 7:
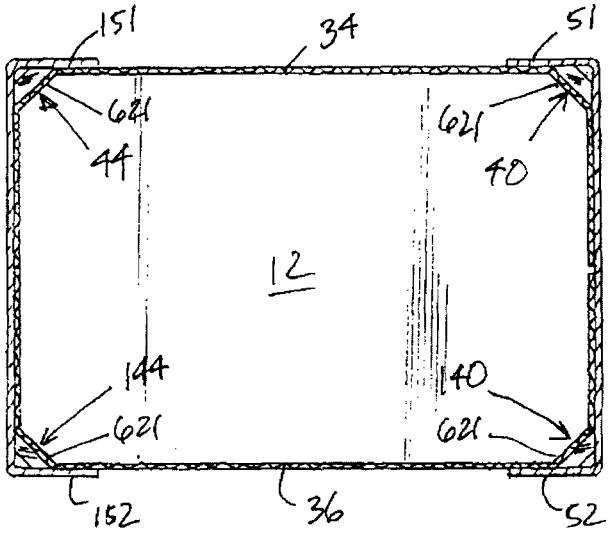
FIG. 7 is a transverse section taken along line 7-7 of FIG. 6 showing an exterior surface of the upper web of each of the four corner bridges.
Figure 8:
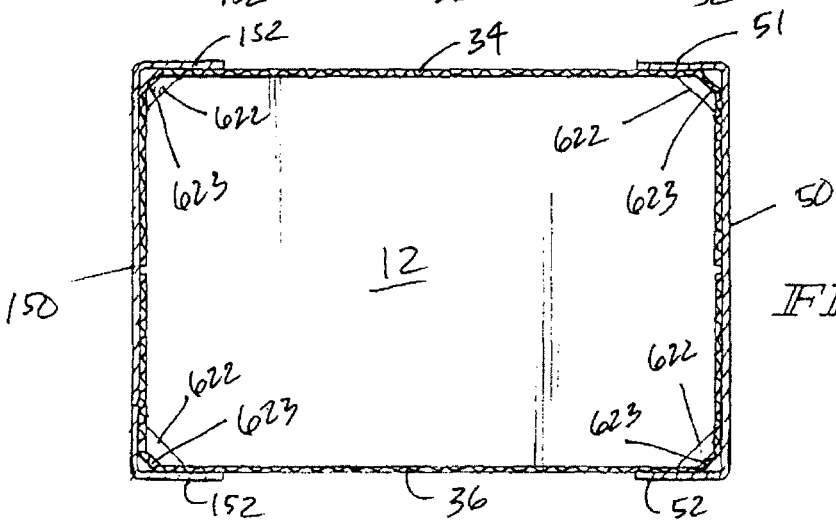
FIG. 8 is a transverse section taken along line 8-8 of FIG. 6 showing an interior surface of the lower web of each of the four corner bridges.
Figure 9:
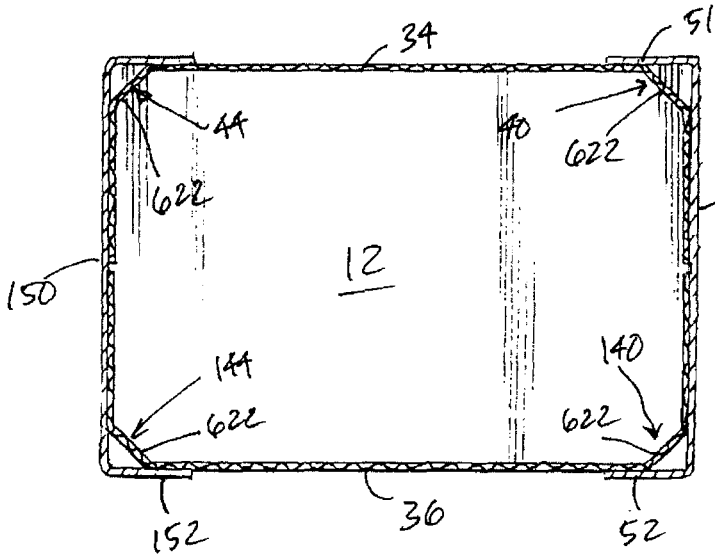
FIG. 9 is a transverse section taken along line 9-9 of FIG. 6 showing a section through the lower web of each of the four corner bridges.
Figure 12:
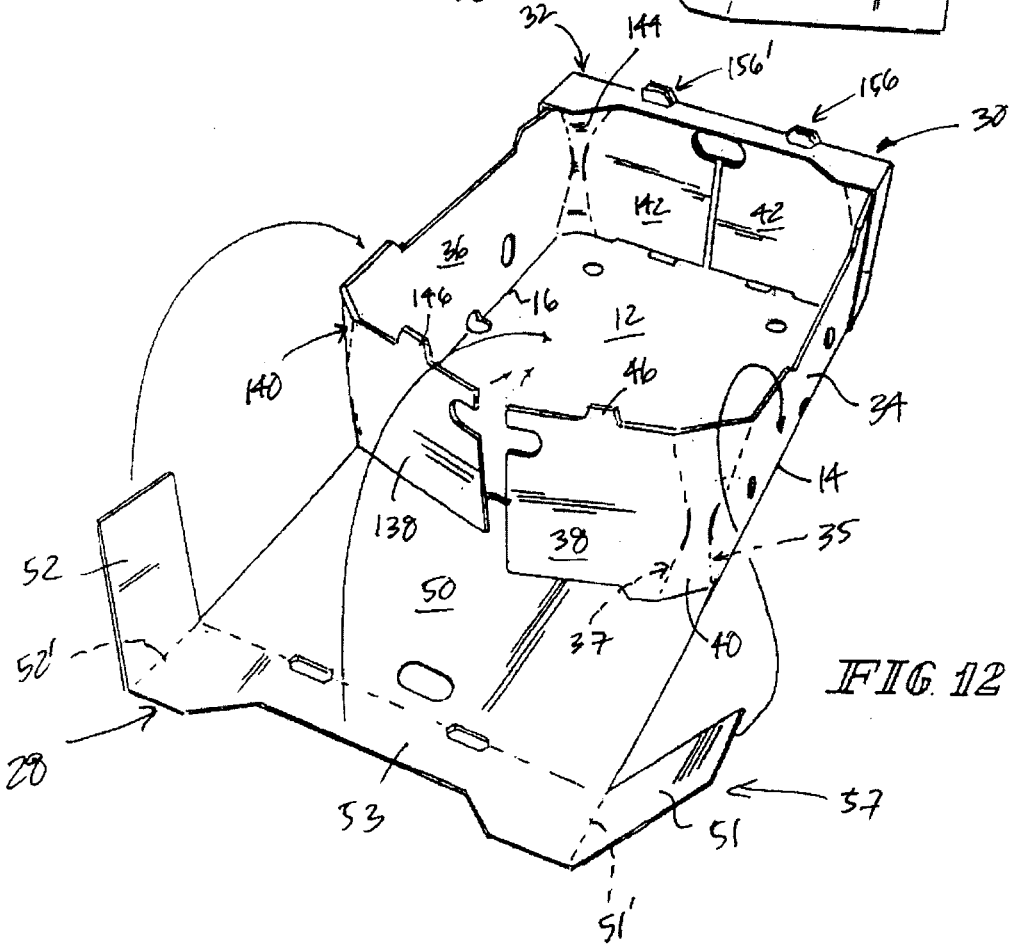
FIG. 12 is a view similar to FIG. 11 showing further folding of portions of the blank to show complete formation of the first and fourth corner bridges associated with a fully formed rear end closure and partial formation of the second and third corner bridges associated with a partly formed front end closure.
Figure 13:
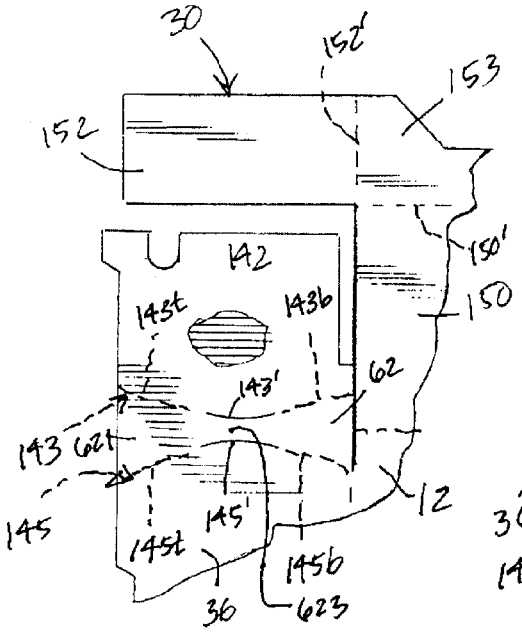
FIG. 13 is an enlarged view of a portion of the blank of FIG. 10 showing the first corner bridge in the rear of the left side strip.

Blank 18 is folded as shown, for example, in FIGS. 11 and 12 to produce the tray 10 shown in FIGS. 5 and 6. Once blank 18 is folded, anchor flaps 51, 52, 151, and 152 are used to retain tray 10 in an erected condition as suggested in FIGS. 5 and 6. First front end wall anchor flap 51 is adhered (using any suitable means) to right side wall 34 and second front end wall anchor flap 52 is adhered (using any suitable means) to left side wall 36 to form front end closure 28. Likewise, first rear end wall anchor flap 151 is adhered (using any suitable means) to right side wall 34 and second rear end wall anchor flap 152 is adhered (using any suitable means) to left side wall 36.

Figure 19:
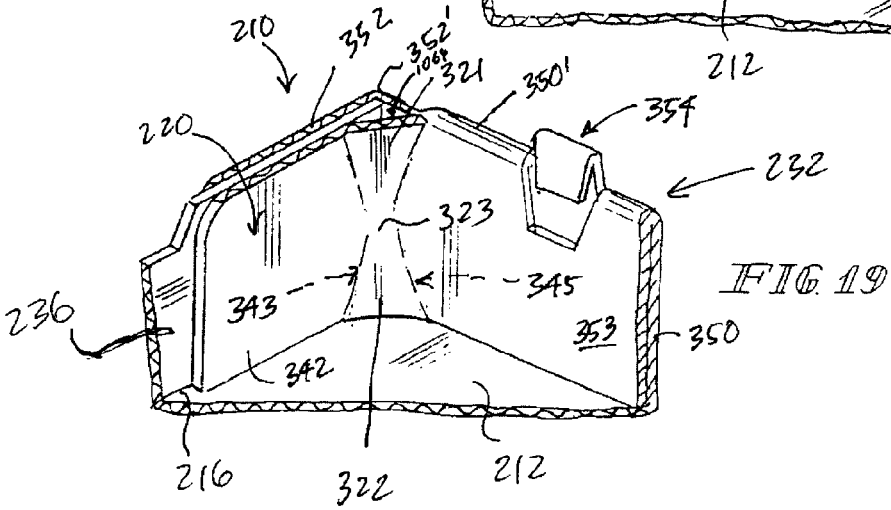

A portion of an article-transport tray 210 is provided, as shown in FIG. 19, for carrying various items. Tray 210 is formed to include an article-storage space 220 for receiving various items such as fruits, vegetables, or any type of agricultural or meat product (not shown). Tray 210 is well-suited to carry a wide variety of other items, articles, or products.

Tray 210 is made, for example, from a blank 218 of corrugated material, as suggested in FIGS. 16-19. Blank 218 includes floor 212, a right side wall 234 appended to floor 212 along fold line 214, a left side wall 236 appended to floor 212 along fold line 216, a front end closure 228 appended to floor 212 along fold line 219, and a rear end closure 230 appended to floor 212 along fold line 221. Rear end closure 230 is configured to be folded to produce a rear end 232 of tray 210 as suggested in FIG. 19. Front end closure 228 is configured to be folded to produce a front end (not shown) of tray 10. It is within the scope of the present disclosure to make blank 218 from a variety of materials including corrugated paperboard, folding carton, and solid fiber and other materials such as plastic sheeting and plastic corrugated.

Front end closure 228 includes an exterior front end wall 250 coupled to one end of floor 212 along fold line 219 and a front anchor strip 257 coupled to exterior front end wall 250 along fold line 250' as suggested in FIG. 16. Front anchor strip 257 includes an interior front end wall 253, a first front end wall anchor flap 238, a front right corner bridge 240, a second front end wall anchor flap 338, and a front left corner bridge 340 as shown in FIG. 16. Each of corner bridges 240, 340 has a shape resembling an hourglass and comprises an upper web 321, a lower web 322, and a medial web 323 interconnecting upper and lower webs 321, 322 as shown, for example, in FIGS. 16 and 19.

Front right corner bridge 240 is arranged to interconnect interior front end wall 253 (second panel) and first front end wall anchor flap 238 (first panel) as shown in FIG. 16. Front right corner bridge 240 is appended to interior front end wall 253 along bow-shaped fold line 235 and to first front end wall anchor flap 238 along bow-shaped fold line 237 as shown in FIG. 16.

Front left corner bridge 340 is arranged to interconnect interior front end wall 253 (first panel) and first rear end wall anchor flap 338 (second panel). Front left corner bridge 340 is appended to interior front end wall 252 along bow-shaped fold line 334 and to first rear end wall anchor flap 338 along bow-shaped fold line 337 as shown in FIG. 16.

Rear end closure 230 includes an exterior rear end wall 350 coupled to an opposite end of floor 212 along fold line 221 and a rear anchor strip 357 coupled to exterior rear end wall 350 along fold line 350' as suggested in FIG. 16. Rear anchor strip 357 includes an interior rear end wall 353, a first rear end wall anchor flap 242, a rear right corner bridge 244, a second rear end wall anchor flap 342, and a rear left corner bridge 344 as shown in FIG. 16. Each of corner bridges 244, 344 has a shape resembling an hourglass and comprises an upper web 321, a lower web 322, and a medial web 323 interconnecting upper and lower webs 321, 322 as shown, for example, in FIGS. 16 and 19.

Rear right corner bridge 244 is arranged to interconnect interior rear end wall (first panel) 353 and first rear end wall anchor flap 242 (second panel) as shown in FIG. 16. Rear right corner bridge 244 is appended to interior rear end wall 352 along first bow-shaped fold line 245 and to first rear end wall anchor flap 242 along second bow-shaped fold line 243.

Rear left corner bridge 344 is arranged to interconnect interior rear end wall 353 (second panel) and second rear end wall anchor flap 342 (first panel). Rear left corner bridge 344 is appended to interior rear end wall 352 along first bow-shaped fold line 345 and to second rear end wall anchor flap 342 along second bow-shaped fold line 343.

In an illustrative embodiment, the corrugation of blank 218 is positioned to run in a longitudinal direction LD as shown in insert A in FIG. 16. It is within the scope of the present disclosure to establish each of the fold lines disclosed herein by using score lines, creases, perforations, or perforations and score lines or by using another suitable technique.

Furthermore, the forming of bow-shaped fold lines 235, 237, 243, 245, 335, 337 343, 345 may be enhanced by using a fold improvement technique. The fold improvement technique involves altering the corrugated materials structure immediately near the cut. Illustratively, the corrugated material is altered by gently crushing a first sheet, positioned to lie closest to the cutting blade, and a corrugated layer positioned to lie between the first sheet and a second sheet. The crushed zones along the bow-shaped fold lines 235, 237, 243, 245, 335, 337 343, 345 allows for a cleaner fold line to be achieved during the process of manufacturing. Illustratively, the crushing is accomplished by the use of hard rubber, cork, or other suitable material placed on the cutting die.

As shown in FIG. 16, front end closure 228 includes two spaced-apart trapezoid-shaped front stacking tabs 254 appended to front end wall 250. As also shown in FIG. 16, rear end closure 230 also includes two trapezoid-shaped rear stacking tabs 354 appended to rear end wall 350.

Blank 218 is folded to produce the article-transport tray 210. Once blank 218 is folded, anchor flaps 251, 252, 351, and 352 are used to retain tray 210 in an erected condition. As shown in FIG. 16, first front end wall anchor flap 251 is coupled to exterior front end wall 250 along fold line 251' and located between (and movable relative to) right side wall 234 and first front end wall anchor flap 238. Second front end wall anchor flap 252 is coupled to exterior front end wall 250 along fold line 252' and located between (and movable relative to) left side wall 236 and second front end wall anchor flap 338. First rear end wall anchor flap 351 is coupled to exterior rear end wall 350 along fold line 351' and located between (and movable relative to) right side wall 234 and first rear end wall anchor flap 242. Second rear end wall anchor flap 352 is coupled to exterior rear end wall 350 along fold line 352' and located between (and movable relative to) left side wall 236 and second rear end wall anchor flap 342. It is within the scope of this disclosure to couple anchor flaps 251, 252, 351, and 352 to interior portions of the companion walls.

First front end wall anchor flap 251 is adhered (using any suitable means) to right side wall 234 and second front end wall anchor flap 252 is adhered (using any suitable means) to left side wall 236 to form front end closure 328. Likewise, first rear end wall anchor flap 351 is adhered (using any suitable means) to right side wall 234 and second rear end wall anchor flap 352 is adhered (using any suitable means) to left side wall 236. Adhesive material is represented by a dot pattern in FIGS. 17 and 18.

Figure 3A:
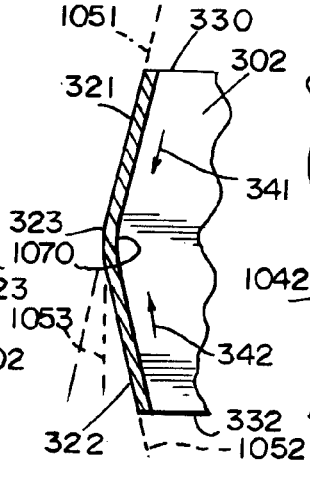
FIG. 3A is a sectional view taken along line 3A-3A of FIG. 3 showing that the corner bridge includes a positively sloping upper web, a negatively sloping lower web, and a medial web interconnecting the upper and lower webs.

As illustrated in FIGS. 3 and 3A, center bridge 303 includes upper web 321, lower web 322, and medial web 323. Upper web 321 is positioned to lie in a first plane 1051 and lower web 322 is arranged to lie in a second plane 1052. First and second planes 1051, 1052 intersect at medial web 323 and establish an obtuse dihedral angle therebetween. The intersection of first and second planes 1051, 1052 further defines a plane intersection line 1006. Medial web 323 is positioned to lie on a third plane 1053 and plan intersection line 1006 also lies on third plane 1053. Third plane 1053 is further arranged to lie generally perpendicular to floor 12.

Illustratively medial web 323, 423 are positioned to lie on a concave surface 1070 facing article-storage space 20. Concave surface 1070 interconnects first and second plane 1051, 1052 as suggested in FIGS. 1-2.

As illustrated in FIG. 4, upper web 321 includes a mount end 1054 and a free end 1056 spaced apart from mount end 1054. Mount end 1054 is formed to have a mount-end width 1042. Mount-end width 1042 is configured to be smaller than a free-end width 1040 included in free end 1056 of upper web 321. Lower web 322 includes a mount end 1058 and a free end 1060 configured to lie in spaced apart relation to mount end 1058. Free end 1060 of lower web 322 is formed to have a free-end width 1044. Mount end 1058 of lower web 322 is formed to have mount-end width 1042 and mount-end width 1042 is configured to smaller than free end width 1044. Medial web 323 is configured to have a width 1060 which is smaller than or equal to mount-end width 1042 of the upper and lower webs 321, 322.

Figure 17:
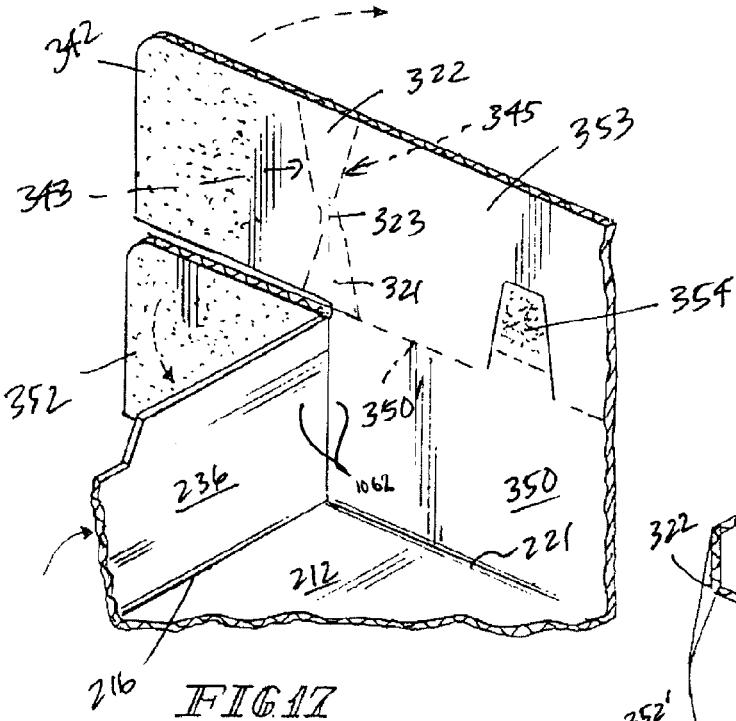
FIGS. 17-19 show a folding sequence during which a left rear portion of the blank of FIG. 16 is folded to produce the hourglass-shaped first corner bridge.
Figure 18:
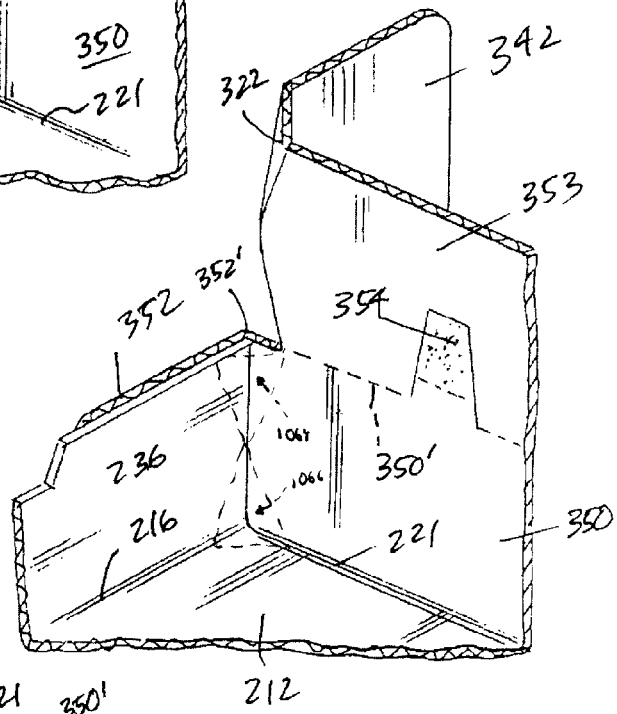

As illustrated in FIGS. 17-19, gusseted container wall 210 further includes an end wall 350 and a side wall 236 coupled together to establish an exterior corner 1062. End wall 350, side wall 236, and upper web 321 cooperated to define a generally tetrahedron shaped space 1064 therebetween. End wall 350, side wall 236, and lower web 322 cooperate to define a generally tetrahedron shaped space 1066 therebetween. First panel 353 may be configured to lie in confronting relation with end wall 350. Second panel 342 may be configured to lie in confronting relation to side wall 236.

A gusseted container wall 2000 in accordance with a third embodiment of the present disclosure is shown, for example, in FIGS. 20 and 21. Gusseted container wall 2000 is well-suited for use in a container similar to article-transport tray 10, 210. Gusseted container wall 2000 includes a first panel 2001, a second panel 2002, and a corner bridge 2003 interconnecting first and second panels 2001, 2002 as shown in FIG. 20. Corner bridge 2003 is appended to first panel 2001 along a first bow-shaped fold line 2011 and second panel 2002 along a second bow-shaped fold line 2012. Illustratively, corner bridge 2003 has a shape resembling an hourglass and comprises an upper web 2021 and a lower web 2022.

First bow-shaped fold line 2011, as shown in FIG. 20, includes a first perforated segment 2005, a second perforated segment 2006, and a first cut segment 2007 interconnecting first and second perforated segments 2005, 2006. Second bow-shaped fold line 2012 includes a first perforated segment 2013, a second perforated segment 2014, and a second cut segment 2008 arranged to interconnect first and second perforated segments 2013, 2014. First and second cut segments 2007, 2008 cooperate to define a window aperture 2010 therebetween. Illustratively, window aperture 2010 may have an hourglass shape.

First cut segment, as illustrated in FIGS. 20 and 21, includes a top cut segment 2015 and a bottom cut segment 2016. Top cut segment 2015 is arranged to interconnect first perforated segment 2005 and bottom cut segment 2016. Bottom cut segment 2015 is arranged to interconnect second perforated segment 2006 and top cut segment 2015. Furthermore, top cut segment 2015 may lie in collinear relationship with top perforated segment 2005 and bottom cut segment 2016 may lie in collinear relationship with second perforated segment 2006.

Second cut segment, as illustrated in FIGS. 20 and 21, includes a top cut segment 2017 and a bottom cut segment 2018. Top cut segment 2017 is arranged to interconnect first perforated segment 2013 and bottom cut segment 2018. Bottom cut segment 2018 is arranged to interconnect second perforated segment 2014 and top cut segment 2017. Furthermore, top cut segment 2017 may be arranged to lie in collinear relationship with top perforated segment 2013 and bottom cut segment 2018 may be arranged to lie in collinear relationship with second perforated segment 2014.

First perforated segments 2005, 2013 of first and second bow-shaped fold lines 2011, 2012 cooperate to define trapezoid shaped upper web 2021. Second perforated segments 2006, 2014 of first and second bow-shaped fold lines 2011, 2012 cooperate to define trapezoid shaped lower web 2022. Upper web 2021 further includes a top side 2031 positioned to lie in coplanar relation to top edge 2430 of gusseted container wall 2000 and a bottom side 2032 positioned to lie generally parallel and in spaced-apart relation to top side 2430. Lower web 2022 further includes a bottom side 2034 positioned to lie in coplanar relation to bottom edge 2430 of gusseted container wall 2000 and a top side 2033 positioned to lie generally parallel and in spaced-apart relation to bottom side 2432 and below bottom side 2032 of upper web 2021.

Bottom side 2032 of upper web 2021 is defined by an upper-web cut line 2035 configured to pass completely through corner bridge 2003 and oriented to face toward window aperture 2010. Top side 2033 of lower web 2022 is defined by a lower-web cut line 2036 configured to pass completely through corner bridge 2003 and oriented to face toward window aperture 2010. Collectively, window aperture 2010 has a generally hourglass shape defined by top side bottom side 2032 of upper web 2021, top side 2033 of lower web 2022, top and bottom cut segments 2015, 2016 of first bow-shaped fold line 2011, and top and bottom cut segments 2017, 2018 of second bow-shaped fold line 2012.

A gusseted container wall 3000, in accordance with a fourth embodiment of the present disclosure, is shown, for example, in FIGS. 22 and 23. Gusseted container wall 3000 is well-suited for use in a container similar to article transport tray 10, 210. Gusseted container wall 3000 includes a first panel 3001, a second panel 3002, an a corner bridge 3003 interconnecting first and second panels 3001, 3002 as shown in FIGS. 22 and 23. Corner bridge 3003 is appended to first panel 3001 along a first bow-shaped fold line 3011 and second panel 3002 along a second bow-shaped fold line 3012. Illustratively, corner bridge 3003 has a shape resembling an hourglass and comprises an upper web 3021 and a lower web 3022.

First bow-shaped fold line 3011, as shown in FIG. 22, includes a first perforated segment 3005, a second perforated segment 3006, and a straight pivot line 3007 interconnecting first and second perforated segments 3005, 3006. Second bow-shaped fold line 3012 includes a first perforated segment 3013, a second perforated segment 3014, and a straight pivot line 3008 arranged to interconnect first and second perforated segments 3013, 3014. First and second straight pivot lines 3007, 3008 cooperate to define a window aperture 3010 therebetween.

First perforated segments 3005, 3013 of first and second bow-shaped fold lines 3011, 3012 cooperate to define trapezoid shaped upper web 3021. Second perforated segments 3006, 3014 of first and second bow-shaped fold lines 3011, 3012 cooperate to define trapezoid shaped lower web 3022. Upper web 3021 further includes a top side 3031 positioned to lie in coplanar relation to a top edge 3430 of gusseted container wall 3000 and a bottom side 3032 positioned to lie generally parallel and in spaced-apart relation to top side 3430. Lower web 3022 further includes a bottom side 3034 positioned to lie in coplanar relation to a bottom edge 3432 of gusseted container wall 3000 and a top side 3033 positioned to lie generally parallel and in spaced-apart relation to bottom side 3432 and below bottom side 3032 of upper web 3021.

A window aperture 3010 is formed in corner bridge 3003 and defined at the top by bottom side 3032 of upper web 3021, at the bottom by top side 3033 of lower web 3022, on one side by first straight pivot line 3007 and on the opposite side by second straight pivot line 3008. Window aperture 3010 illustratively has a rectangular shape as suggested in FIG. 22.

Illustratively, first panel 3001 includes a first panel section 3051 and a first panel wing 3052. First panel wing 3052 is appended to first panel section 3051 along first straight pivot line 3007 and positioned to lie in coplanar relation to first panel section 3051. Second panel 3002 includes a second panel section 3061 and a second panel wing 3062. Second panel wing 3062 is appended to second panel section along second straight pivot line 3008 and positioned to lie in coplanar relation to second panel section 3062.

A gusseted container wall 4000, in accordance with a fifth embodiment of the present disclosure, is shown, for example in FIGS. 25 and 26. Gusseted container wall 4000 is well-suited for use in an article-transport tray 4010 illustrated in FIG. 26. Gusseted container wall 4000 includes a first panel 4001, a second panel 4002, an a corner bridge 4003 interconnecting first and second panels 4001, 4002 as shown in FIGS. 24-26. Corner bridge 4003 is appended to first panel 4001 along a first bow-shaped fold line 4011 and second panel 4002 along a second bow-shaped fold line 4012. Illustratively, corner bridge 4003 has a shape resembling an hourglass and comprises an upper web 4021 and a lower web 4022.

Gusseted container wall 4000 also includes a top edge 4430 positioned to lie in spaced apart relation above a floor 4212 included in article-transport tray 4010 and a bottom edge 4432 positioned to lie in spaced apart relation above floor 4212 and below top edge 4430. Illustratively, gusseted container wall 4000 is configured to have a gusset height 4051 that is less than or equal to about half a container height 4052. Gusseted container wall 4000 in this configuration operates to minimize the nesting of upper article-transport tray 4110 into lower article-transport tray 4210 as illustrated in FIG. 26. The difference in height between gusset height 4051 and container height 4052 allows for reduction in nesting potential while reducing the amount of corrugated material required to form gusseted container wall 4000.

Article-transport tray 4010 is made, for example, from a blank 4218 as suggested in FIG. 24. Blank 4218 includes floor 4212, a right side wall 4234 appended to floor 4212 along fold line 4214, a left side wall 4236 appended to floor 4212 along fold line 4216, a front end closure 4228 appended to floor 4212 along fold line 4219, and a rear end closure 4230 appended to floor 4212 along fold line 4221. Rear end closure 4230 is configured to be folded to produce a rear end 4232 of tray 4210 as suggested in FIG. 26. Front end closure 4228 is configured to be folded to produce a front end 4234 of tray 4010 as suggested in FIGS. 25 and 26. It is within the scope of the present disclosure to make blank 4218 from a variety of materials including corrugated paperboard, folding carton, and solid fiber and other materials such as plastic sheeting and plastic corrugated material.

Front end closure 4228 includes an exterior front end wall 4250 coupled to one end of floor 4212 along fold line 4219 and a front anchor strip 4257 coupled to exterior front end wall 4250 along fold line 4250' as suggested in FIG. 24. Front anchor strip 4257 includes an interior front end wall 4253, a first front end wall anchor flap 4238, a front right corner bridge 4240, a second front end wall anchor flap 4338, and a front left corner bridge 4340 as shown in FIG. 24. Each of corner bridges 4240, 4340 has a shape resembling an hourglass and comprises an upper web 4321 and a lower web 4322 as shown, for example, in FIGS. 24-26.

Rear end closure 4230 includes an exterior rear end wall 4350 coupled to an opposite end of floor 4212 along fold line 4221 and a rear anchor strip 4357 coupled to exterior rear end wall 4350 along fold line 4350' as suggested in FIG. 24. Rear anchor strip 4357 includes an interior rear end wall 4353, a first rear end wall anchor flap 4242, a rear right corner bridge 4244, a second rear end wall anchor flap 4342, and a rear left corner bridge 4344 as shown in FIG. 24. Each of corner bridges 4244, 4344 has a shape resembling an hourglass and comprises an upper web 4321 and a lower web 4322 as shown, for example, in FIGS. 24-26.

In an illustrative embodiment, the corrugation of blank 4218 is positioned to run in a longitudinal direction LD as shown in insert A in FIG. 24. It is within the scope of the present disclosure to establish each of the fold lines disclosed herein by using score lines, creases, perforations, or perforations and score lines or by using another suitable technique.

Blank 4218 is folded to produce the article-transport tray 4210 shown in FIG. 26. Once blank 4218 is folded, anchor flaps 4251, 4252, 4351, and 4352 are used to retain tray 4210 in an erected condition. As shown in FIG. 24, first front end wall anchor flap 4251 is coupled to exterior front end wall 4250 along fold line 4251' and located between (and movable relative to) right side wall 4234 and first front end wall anchor flap 4238. Second front end wall anchor flap 4252 is coupled to exterior front end wall 4250 along fold line 4252' and located between (and movable relative to) left side wall 4236 and second front end wall anchor flap 4338. First rear end wall anchor flap 4351 is coupled to exterior rear end wall 4350 along fold line 4351' and located between (and movable relative to) right side wall 4234 and first rear end wall anchor flap 4242. Second rear end wall anchor flap 4352 is coupled to exterior rear end wall 4350 along fold line 4352' and located between (and movable relative to) left side wall 4236 and second rear end wall anchor flap 4342. It is within the scope of this disclosure to couple anchor flaps 4251, 4252, 4351, and 4352 to interior portions of the companion walls.

First front end wall anchor flap 4251 is adhered (using any suitable means) to right side wall 4234 and second front end wall anchor flap 4252 is adhered (using any suitable means) to left side wall 4236 to form front end closure 4328. Likewise, first rear end wall anchor flap 4351 is adhered (using any suitable means) to right side wall 4234 and second rear end wall anchor flap 4352 is adhered (using any suitable means) to left side wall 4236.

Illustratively, article-transport tray 4010 includes a plurality of alignment tabs 4156, 4256, 4356, 4456 appended to top edge 4430 of gusseted container wall as illustrated in FIGS. 25 and 26. As an example, rear anchor strip 4357 is coupled to rear end wall 4350 along fold line 4350'. Alignment tabs 4356 is formed by folding first and second alignment wings **4356*a* and 4356*b* along fold line 4350'. First alignment wing 4356*a* interconnects interior rear end wall 4353 of rear anchor strip 4357 and second alignment wing 4356*b*. Second alignment wing is appended to first alignment wing 4356*a* along fold line 4350' and to rear end wall 4350. Folding rear anchor strip along fold line 4350' establishes alignment tabs 4356, 4456. Alignment tabs 4156, 4256 are formed in a similar manner as forming alignment tabs 4356, 4456**.

The invention claimed is:

1. An article-transport tray comprising a floor and side walls and end walls coupled to and arranged to cooperate with the floor to define an article-storage space therebetween, wherein the side walls and end walls are foldably attached to one another and having a gusseted corner configuration being defined by a first panel, a second panel, and a corner bridge positioned to lie between the first and second panels, the corner bridge is appended to the first panel along a first vertically orientated bow-shaped fold line and appended to the second panel along a second vertically orientated bow-shaped fold line, and the first and second vertically orientated bow-shaped fold lines are arranged to lie in spaced-apart and mirrored relation to one another to define the corner bridge therebetween and the first and second panels being configured to be perpendicular to one another, with the corner bridge being positioned in a diagonal relationship therebetween, wherein the first vertically orientated bow-shaped fold line includes a first perforated segment, the second vertically orientated bow-shaped fold line includes a first perforated segment, and the first perforated segments of the first and second bow-shaped fold lines are arranged to lie in diverging relation to one another and wherein the first vertically orientated bow-shaped fold line includes a second perforated segment, the second vertically orientated bow-shaped fold line includes a second perforated segment, and the second perforated segments of the first and second bow-shaped fold lines are arranged to lie in diverging relation to one another and wherein the first perforated segments of the first and second vertically orientated bow-shaped fold lines cooperate to define a trapezoid-shaped upper web therebetween and the second perforated segments of the first and second vertically orientated bow-shaped fold lines cooperate to define a trapezoid-shaped lower web therebetween.

2. The article-transport tray of claim 1, wherein the first and second perforated segments of the first vertically orientated bow-shaped fold line are arranged to lie in diverging relation to one another to define a first obtuse angle included therebetween, the first and second perforated segments of the second vertically orientated bow-shaped fold line are arranged to lie in diverging relation to one another to define a second obtuse angle included therebetween, the first perforated segments of the first and second vertically orientated bow-shaped fold lines cooperate to define a first acute angle included therebetween, and the second perforated segments of the first and second vertically orientated bow-shaped fold line cooperate to define a second acute angle included therebetween.

3. The article-transport tray of claim 1, wherein the first vertically orientated bow-shaped fold line further includes a first curved slit arranged to interconnect the first and second perforated segments of the first vertically orientated bow-shaped fold line and the second vertically orientated bow-shaped fold line further includes a second curved slit arranged to interconnect the first and second perforated segments of the second vertically orientated bow-shaped fold line.

4. The article-transport tray of claim 1, wherein the first and second perforated segments of the first bow-shaped fold line intersect at a first point and the first and second perforated segments of the second bow-shaped fold line intersect at a second point.

5. The article-transport tray of claim 4, wherein the first point and the second point are arranged to lie on a line and the line is positioned to lie in spaced apart relation generally parallel to the floor.

6. The article-transport tray of claim 1, wherein the first vertically orientated bow-shaped fold line further includes a first curved slit arranged to interconnect the first and second perforated segments of the first vertically orientated bow-shaped fold line.

7. The article-transport tray of claim 6, wherein the first curved slit is shaped to define a first concave edge of the corner bridge and is arranged to face in a first direction toward the first panel, the second vertically orientated bow-shaped fold line further includes a second curved slit arranged to interconnect the first and second perforated segments of the second vertically orientated bow-shaped fold line, the second curved slit is shaped to define a second concave edge of the corner bridge, and the second concave edge of the corner bridge is arranged to lie in spaced-apart relation to the first concave edge and facing in a second direction toward the second panel to define a medial web therebetween.

8. The article-transport tray of claim 7, wherein the first perforated segments of the first and second bow-shaped fold lines cooperate to define a trapezoid-shaped upper web therebetween, the second perforated segments of the first and second bow-shaped fold lines cooperate to define a trapezoid-shaped lower web therebetween, and the medial web is arranged to lie between and interconnect the trapezoid-shaped upper and lower webs.

9. The article-transport tray of claim 1, wherein the first bow-shaped fold line further includes a first cut segment interconnecting the first and second perforated segments and the second bow-shaped fold line further includes a second cut segment interconnecting the first and second perforated segment.

10. The article-transport tray of claim 9, wherein the first and second cut lines cooperate to define a window aperture therebetween and opening into the article-storage space.

11. The article-transport tray of claim 10, wherein the first cut line includes a top-cut segment and a bottom-cut segment, the top-cut segment is positioned to interconnect the first perforated segment and the bottom-cut segment and lie in collinear relation to the first perforated segment, and the bottom-cut segment is positioned to interconnect the second perforated segment and the top-cut segment and lie in collinear relation to the second perforated segment.

12. The article-transport tray of claim 10, wherein the first perforated segments of the first and second bow-shaped fold lines cooperate to define a trapezoid-shaped upper web therebetween and the second perforated segments of the first and second bow-shaped fold lines cooperate to define a trapezoid-shaped lower web therebetween.

13. The article-transport tray of claim 12, wherein the gusseted container wall further includes a top edge positioned to lie in spaced-apart relation to the floor and a bottom edge positioned to lie between the top edge and the floor, the trapezoid-shaped upper web includes a top side positioned to lie in coplanar relation to the top edge and a bottom side positioned to parallel to and spaced apart from the top side, and the trapezoid-shaped lower web includes a bottom side positioned to lie in coplanar relation to the floor and a top side positioned to lie above the bottom side of the trapezoid-shaped lower web and below the bottom side of the trapezoid-shaped upper web.

14. The article-transport tray of claim 13, wherein the bottom side of the trapezoid-shaped upper web is defined by an upper-web cut line and the top side of the trapezoid-shaped lower web is defined by a lower-web cut line.

15. The article-transport tray of claim 1, wherein the first bow-shaped fold line further includes a first slit connected to the first perforated segment, the second vertically orientated bow-shaped fold line further includes a second slit connected to the first perforated segment, and the second slit is positioned to lie in spaced-apart relation from the first slit.

16. The article-transport tray of claim 15, wherein the side walls and end walls further includes a top edge positioned to lie in spaced-apart relation to the floor and a bottom edge positioned to lie between the top edge and the floor, the first perforated segment of the first vertically orientated bow-shaped fold line extends from the top edge toward the bottom edge, the first slit is positioned to lie below the first perforated segment to cause the first slit to extend from the bottom edge upwardly toward the top edge to connect to the first perforated segment, the first perforated segment of the vertically orientated second bow-shaped fold line extends from the top edge toward the bottom edge, and the second slit is positioned to lie below the first perforated segment of the second bow-shaped fold line to cause the second slit to extend from the bottom edge upwardly toward the top edge to connect to the first perforated segment.

17. The article-transport tray of claim 15, wherein the first slit of the first bow-shaped fold line is curved inwardly toward the center bridge to produce a first concave edge of the center bridge facing toward the first panel and the second slit of the second vertically orientated bow-shaped fold line is curved inwardly toward the center bridge to produce a second concave edge of the center bridge facing toward the second panel.

18. The article-transport tray of claim 17, wherein the first perforated segment of the first bow-shaped fold line cooperates with the second perforated segment of the second vertically orientated bow-shaped fold line to define a trapezoid-shaped upper web included in the corner bridge and the first curved slit of the first vertically orientated bow-shaped fold line cooperates with the second curved slit of the second bow-shaped fold line to define a medial web therebetween.

19. The article-transport tray of claim 1, wherein the corner bridge includes a first bridge side defined by the first vertically orientated bow-shaped fold line facing toward the first panel and a second bridge side defined by the second vertically orientated bow-shaped fold line facing toward the second panel.

20. The article-transport tray of claim 19, wherein the side walls and end walls further includes a top edge spaced apart from and generally parallel to the floor and a bottom edge positioned to lie between the floor and the top edge and generally parallel to the floor and the corner bridge further includes a top bridge side generally coplanar with the top edge of the gusseted container wall and a bottom bridge side spaced apart from the top bridge side and generally coplanar with the bottom edge of the gusseted container wall.

21. The article-transport tray of claim 19, wherein the first bridge side includes a first top side portion positioned to lie above the floor, a first center side portion positioned to lie below the first top side portion and above the floor, and a first bottom side portion positioned to lie below the first center side portion and above the floor, and the second bridge side includes a second top side portion positioned to lie above the floor, a second center side portion positioned to lie below the second top side portion and above the floor, and a second bottom side portion positioned to lie below the second center side portion and above the floor.

22. The article-transport tray of claim 21, wherein the first and second top side portions are spaced apart from each other to define a top distance therebetween, the first and second center side portions are spaced apart from each other define a center distance therebetween, and the first and second bottom side portions are spaced apart from each other to define a bottom distance therebetween, and the top distance is greater than the center distance.

23. The article-transport tray of claim 22, wherein the bottom distance is greater than the center distance and about equal to the top distance.

24. An article-transport tray comprising a floor and side walls and end walls coupled to and arranged to cooperate with the floor to define an article-storage space therebetween, wherein each of the side walls and end walls includes a top edge positioned to lie above the floor and a bottom edge positioned to lie below the top edge and above the floor, side walls and end walls are foldably attached to one another and having a gusseted corner configuration being defined by a first panel, a second panel, and a corner bridge positioned to lie between the first panel and the second panel, the corner bridge is appended to the first panel along a first vertically orientated bow-shaped fold line and appended to the second panel along a second vertically orientated bow-shaped fold line, the first and second vertically orientated bow-shaped fold lines are arranged to lie in spaced-apart and mirrored relation to one another to define the corner bridge therebetween and the first and second panels being configured to be perpendicular to one another, with the corner bridge being positioned in a diagonal relationship therebetween, and the vertically orientated first bow-shaped fold line includes a first perforated segment extending downwardly from the top edge toward the bottom edge of the gusseted side wall, a second perforated segment extending upwardly from the bottom edge toward the top edge of the gusseted side wall, and a first curved slit positioned to lie between and arranged to interconnect the first and second perforated segments of the first bow-shaped fold line.

25. The article-transport tray of claim 24, wherein the vertically orientated second bow-shaped fold line includes a first perforated segment arranged to extend downwardly from the top edge toward the bottom edge of the gusseted side wall, a second perforated segment arranged to extend upwardly from the bottom edge toward the top edge of the gusseted side wall, and a second curved slit positioned to lie between and arranged to interconnect the first and second perforated segments of the second bow-shaped fold line.

26. The article-transport tray of claim 25, wherein the first curved slit is arranged to curve inwardly toward the corner bridge to produce a first concave edge facing toward the first panel, the second curved slit is arranged to curve inwardly toward the corner bridge to produce a second concave edge facing toward the second panel, and the first and second concave edges define a medial web included in the corner bridge therebetween.

27. The article-transport tray of claim 25, wherein the first bottom perforated segment is arranged to curve outwardly away from the center bridge to produce a first bottom convex edge arranged to face the first panel, the second bottom perforated segment is arranged to curve outwardly away from the center bridge to produce a second bottom convex edge arranged to face the second panel, and the first and second bottom convex edges cooperate to define a lower web included in the corner bridge therebetween.

28. The article-transport tray of claim 24, wherein the first top perforated segment is arranged to curve outwardly away from the center bridge to produce a first top convex edge facing the first panel, the second top perforated segment is arranged to curve outwardly away from the center bridge to produce a second top convex edge facing the second panel, and the first and second top convex edges cooperate to define an upper web included in the corner bridge therebetween.

29. The article-transport tray of claim 24, wherein the corner bridge includes an upper web positioned to lie in a first plane, a lower web positioned to lie in a second plane, a medial web positioned to lie in a third plane, and the medial web is arranged to interconnect the upper and lower webs.

30. The article-transport tray of claim 29, wherein the medial web includes a width configured to be less than or equal to the mount end width of the upper web.

31. The article-transport tray of claim 29, wherein the first plane and the second plane intersect at the medial web to establish an obtuse dihedral angle therebetween.

32. The article-transport tray of claim 31, wherein the upper web includes a mount end coupled to the medial web, a free end positioned to lie in spaced-apart relation to the mount end, and the mount end has a mount-end width configured to be smaller than a free-end width of the free end of the upper web.

33. The article-transport tray of claim 31, wherein the lower web includes a mount end coupled to the medial web, a free end positioned to lie in spaced apart relation to the mount end, and the free end includes a free-end width configured to be larger than a mount-end width included in the mount end of the lower web.

34. The article-transport tray of claim 33, wherein the medial web includes a width configured to be equal to or smaller than the mount end width of the lower web.

35. An article-transport tray comprising a floor and side walls and end walls coupled to and arranged to cooperate with the floor to define an article-storage space therebetween, wherein the side walls and end walls are foldably attached to one another and includes four reinforced corners, each reinforced corner includes a first panel, a second panel, and a corner bridge positioned to lie between the first panel and the second panel and configured to increase the stacking strength of the article-transport tray, the corner bridge is appended to the first panel along a first vertically orientated bow-shaped fold line and appended to the second panel along a second vertically orientated bow-shaped fold line, the first and second bow-shaped fold lines are arranged to lie in spaced-apart and mirrored relation to one another to define the corner bridge therebetween and the first and second panels being configured to be perpendicular to one another, with the corner bridge being positioned in a diagonal relationship therebetween, and wherein the corner bridge includes a upper web positioned to lie in a first plane and a lower web positioned to lie in a second plane.

36. The article-transport tray of claim 35, wherein the corner bridge further includes a medial web positioned to lie on a concave surface facing the article-storage space and the medial web interconnects the top and bottom webs.

37. The article-transport tray of claim 35, wherein the gusseted container wall includes a top edge positioned to lie above the floor and a bottom edge positioned to lie below the top edge and above the floor, the upper web includes a first upper-web side positioned to lie in coplanar relation to the top edge of the container wall and a second upper-web side positioned to lie in spaced-apart relation and parallel to the first upper-web side, the lower web includes a first lower-web side positioned to lie in coplanar relation to the bottom edge of the container wall and a second lower-web side positioned to lie in spaced-apart relation and parallel to the first lower-web side.

38. The article-transport tray of claim 37, wherein the second upper-web side of the upper web is positioned to lie in spaced-apart relation to the second lower-web side and the second lower-web side, the second upper-web side, and the first and second bow-shaped fold lines cooperate to define a window aperture therebetween.

39. The article-transport tray of claim 38, wherein the window aperture has a generally hourglass shape.

40. The article-transport tray of claim 35, wherein the first bow-shaped fold includes a first perforated segment, a second perforated segment, and a first straight pivot line segment interconnecting the first and second perforated segments and the second bow-shaped fold line includes a first perforated segment, a second perforated segment, and a second straight pivot line segment interconnecting the first and second perforated segments of the second bow-shaped fold line.

41. The article-transport tray of claim 40, wherein the straight pivot line segments of the first and second bow-shaped fold lines cooperate to define a window aperture therebetween opening into the article-storage space.

42. The article-transport tray of claim 41, wherein the window aperture has a generally rectangular shape.

43. The article-transport tray of claim 41, wherein the first panel includes a first panel section and an first panel wing appended to the first panel section along the straight pivot line of first bow-shaped fold line and the first panel wing is positioned to lie in coplanar relation to the first panel section.

44. The article-transport tray of claim 43, wherein the second panel includes a second panel section and a second panel wing appended to the second panel section along the straight pivot line of the second bow-shaped fold line and the second panel wing is positioned to lie in coplanar relation to the second panel section.

* * * * *

UNITED STATES PATENT AND TRADEMARK OFFICE

CERTIFICATE OF CORRECTION

PATENT NO. : 8,651,277 B2
APPLICATION NO. : 12/242339
DATED : February 18, 2014
INVENTOR(S) : Michael Bruce McLeod and Jon Richard Thomas Schoenborn It is certified that error appears in the above-identified patent and that said Letters Patent is hereby corrected as shown below:

Item (73) the "Name of Assignee" listed on the Title Page of patent USP 8,651,277 was erroneously indicated as "International Paper Company"

The "Name of Assignee" should be "TIN, Inc."

Signed and Sealed this
Fourth Day of August, 2015

Michelle K. Lee

Michelle K. Lee
*Director of the United States Patent and Trademark Office*